US007088314B2

(12) United States Patent
Harada et al.

(10) Patent No.: US 7,088,314 B2
(45) Date of Patent: Aug. 8, 2006

(54) SURFACE DISCHARGE TYPE PLASMA DISPLAY PANEL HAVING AN ISOSCELES DELTA ARRAY TYPE PIXEL

(75) Inventors: Shigeki Harada, Tokyo (JP); Kou Sano, Tokyo (JP); Shinsuke Yura, Tokyo (JP)

(73) Assignee: Mitsubishi Denki Kabushiki Kaisha, Tokyo (JP)

( * ) Notice: Subject to any disclaimer, the term of this patent is extended or adjusted under 35 U.S.C. 154(b) by 298 days.

(21) Appl. No.: 10/479,491

(22) PCT Filed: Apr. 17, 2002

(86) PCT No.: PCT/JP02/03844

§ 371 (c)(1),
(2), (4) Date: Dec. 3, 2003

(87) PCT Pub. No.: WO03/088297

PCT Pub. Date: Oct. 23, 2003

(65) Prior Publication Data

US 2004/0155267 A1 Aug. 12, 2004

(51) Int. Cl.
*G09G 3/28* (2006.01)

(52) U.S. Cl. ..... 345/60; 345/66

(58) Field of Classification Search ..... 345/60–63, 345/66, 68, 74.1, 76, 208; 315/169.4
See application file for complete search history.

(56) References Cited

U.S. PATENT DOCUMENTS 6,747,409 B1 * 6/2004 Han et al. ..... 313/582
2001/0024092 A1 * 9/2001 Kim et al. ..... 315/169.4
2003/0098825 A1 * 5/2003 Kim et al. ..... 345/63

FOREIGN PATENT DOCUMENTS

| | | | |
|---|---|---|---|
| JP | 2-288047 | A | 11/1990 |
| JP | 3-84831 | A | 4/1991 |
| JP | 6-44907 | A | 2/1994 |
| JP | 2000-11899 | A | 1/2000 |
| JP | 2000-357463 | A | 12/2000 |

* cited by examiner

*Primary Examiner*—Ricardo Osorio
*Assistant Examiner*—Mansour M. Said
(74) *Attorney, Agent, or Firm*—Birch, Stewart, Kolasch and Birch, LLP

(57) ABSTRACT

The present invention relates to an AC drive surface discharge type plasma display panel having an isosceles delta array type pixel. The background art has a problem of being apt to cause a wrong writing discharge and having a narrow writing voltage margin. Then, in the present invention, transparent electrodes for X electrode (T3, T4) in first and second pair subpixel regions (PSPR1, PSPR2) of an isosceles delta array type pixel (P1) are provided at portions farther away from a first write electrode (Wj(B)) in an isolated subpixel region (ISPR). Specifically, a central axis of the third transparent electrode (T3) along a vertical direction (v) is positioned closer to an extending portion (WAE) of a second write electrode (Wj(A)) from a vertical direction central axis of the first pair subpixel region (PSPR1). Similarly, a vertical direction central axis of the fourth transparent electrode (T4) is positioned closer to an extending portion (WCE) of a third write electrode (Wj(C)) from a vertical direction central axis of the second pair subpixel region (PSPR2). The present invention is mainly used for a display device such as a plasma television.

10 Claims, 13 Drawing Sheets

SURFACE DISCHARGE TYPE PLASMA DISPLAY PANEL HAVING AN ISOSCELES DELTA ARRAY TYPE PIXEL

TECHNICAL FIELD

The present invention relates to a surface discharge type plasma display panel (hereinafter, a plasma display panel is also referred to simply as a "PDP") having an isosceles delta array type pixel constituted of three subpixels (also referred to simply as "cells") disposed at the respective vertices of an isosceles triangle, and more particularly to a technique to improve driving characteristic of the PDP.

BACKGROUND ART

A delta array type pixel is one pixel constituted of three subpixels arranged at vertices of a triangle, and an exemplary case where such-a delta array type pixel is applied to an AC surface discharge type PDP is disclosed in Japanese Patent Application Laid Open Gazette No. 2000-357463.

Further, a method of reducing a circuit cost by commonality of two data electrodes which is based on this structure (this method is referred to as "W electrode common address driving method") is disclosed in Japanese Patent Application Laid Open Gazette No. 2000-298451.

Furthermore, Japanese Patent Application Laid Open Gazette No. 2000-135242 discloses a method of lowering a peak value of discharge current to reduce a circuit cost by decentralizing paths for sustain discharge currents (this method is referred to as "current dispersion method").

Further, in an AC surface discharge type PDP having a delta array type pixel, a method of improving resolution by performing a pseudo interlacing drive (unknown art: no-prior art) is recently proposed by Mitsubishi Denki Kabushiki Kaisha (Mitsubishi Electric Corporation) (JP Application No. 2001-293473, U.S. patent application Ser. No. 09/990,344).

Thus, a PDP having a delta array type pixel has such various advantages as above.

It is pointed out, however, that in PDPs each having a delta array type pixel which are proposed openly or not-openly, a phenomenon that a display light does not look white due to mixture of red, blue and green, i.e., "color separation", is apt to occur since each spacing between subpixels is relatively large.

Then, to solve the problem of "color separation", Mitsubishi Denki Kabushiki Kaisha proposes a PDP having a new delta array type pixel although it is an unpublished art (no-prior art) (JP Application No. 2002-7360). Specifically, in this no-prior art, a distance between subpixels is set relatively short by bringing two subpixels positioned at the vertices of a base of isosceles triangle closer. This structure allows a pitch between subpixels in one pixel to become relatively small, thereby solving the problem of "color separation". The delta array type pixel is hereinafter referred to as an "isosceles delta array type pixel".

DISCLOSURE OF INVENTION

There arises a new problem in an AC surface discharge type PDP having isosceles delta array type pixels, however, that a writing voltage margin is small.

The present invention is intended to solve the above problem, and it is a main object of the present invention to increase a writing voltage margin and suppress generation of wrong writing discharge in pair subpixels of an AC surface discharge type PDP having an isosceles delta array type pixel.

Further, it is a subobject of the present invention to suppress variation in writing voltage margin among subpixels.

Furthermore, it is also a subobject of the present invention to suppress deviation of a center of luminescence distribution from a center of subpixel.

The present invention is intended for a surface discharge type plasma display panel including a pixel constituted of first, second and third subpixels which are positioned at respective vertices of an isosceles triangle. According to a first aspect of the present invention, the surface discharge type plasma display panel includes a rear substrate having a first write electrode extending in a vertical direction and second and third write electrodes which sandwich the first write electrode therebetween and both extend in the vertical direction; a front substrate having a peripheral portion sealed to the rear substrate, an outer surface forming a display surface and an inner surface opposed to an inner surface of the rear substrate; a first horizontal barrier rib formed on the inner surface of the rear substrate, extending in a horizontal direction orthogonal to the vertical direction; second and third horizontal barrier ribs formed on the inner surface of the rear substrate, which sandwich the first horizontal barrier rib therebetween and extend in the horizontal direction; a first vertical barrier rib formed on a portion in the inner surface of the rear substrate which is positioned immediately above the first write electrode, extending in the vertical direction to connect the first and second horizontal barrier ribs to each other; second and third vertical barrier ribs formed on the inner surface of the rear substrate, which sandwich the first vertical barrier rib therebetween, extend in the vertical direction and connect the first and second horizontal barrier ribs to each other; a fourth vertical barrier rib formed on a portion in the inner surface of the rear substrate which is positioned between the first write electrode and the second write electrode, extending in the vertical direction to connect the first and third horizontal barrier ribs to each other; a fifth vertical barrier rib formed on a portion in the inner surface of the rear substrate which is positioned between the first write electrode and the third write electrode, extending in the vertical direction to connect the first and third horizontal barrier ribs to each other; a sustain electrode formed on the inner surface of the front substrate, extending in the horizontal direction to grade-separately intersect the first, second and third write electrodes; first and second scan electrodes formed on the inner surface of the front substrate, which sandwich the sustain electrode therebetween, extend in the horizontal direction and grade-separately intersect the first, second and third write electrodes; and a dielectric layer formed on the inner surface of the front substrate, the dielectric layer covering the sustain electrode and the first and second scan electrodes and including a surface which is in contact with respective tops of the first horizontal barrier rib, the second horizontal barrier rib, the third horizontal barrier rib, the first vertical barrier rib, the second vertical barrier rib, the third vertical barrier rib, the fourth vertical barrier rib and the fifth vertical barrier rib, and in the surface discharge plasma display panel, the first write electrode is positioned at least in an isolated subpixel region defined by a vertical direction central axis of the fourth vertical barrier rib, a vertical direction central axis of the fifth vertical barrier rib, a horizontal direction central axis of the first horizontal barrier rib and a horizontal direction central axis of the third horizontal barrier rib, the second write electrode is positioned at least in a first pair subpixel region defined by a vertical direction central axis of the first vertical barrier rib, a vertical direction central axis of the second vertical barrier rib, the horizontal direction central axis of the first horizontal barrier rib and a horizontal direction central axis of the second horizontal barrier rib, the third write electrode is positioned at least in a second pair subpixel region defined by the vertical direction central axis of the first vertical barrier rib, a vertical direction central axis of the third vertical barrier rib, the horizontal direction central axis of the first horizontal barrier rib and the horizontal direction central axis of the second horizontal barrier rib, the first pair subpixel region forms the first subpixel positioned at one of vertices constituting a base of the isosceles triangle, the isolated subpixel region forms the second subpixel positioned at top of the isosceles triangle opposed to the base, and the second pair subpixel region forms the third subpixel positioned at the other one of vertices constituting the base, and the surface discharge type plasma display panel further includes a first phosphor layer formed on at least the inner surface of the rear substrate in the first pair subpixel region; a second phosphor layer formed on at least the inner surface of the rear substrate in the isolated subpixel region; and a third phosphor layer formed on at least the inner surface of the rear substrate in the second pair subpixel region, in the surface discharge plasma display panel, the sustain electrode includes a first metal auxiliary electrode positioned immediately above the first horizontal barrier rib, extending in the horizontal direction; a first transparent electrode positioned in the first pair subpixel region, protruding from a portion of the first metal auxiliary electrode which is positioned between the portion positioned immediately above the connection between the first horizontal barrier rib and the first vertical barrier rib and a portion positioned immediately above a connection between the first horizontal barrier rib and the second vertical barrier rib towards the first scan electrode; a second transparent electrode positioned in the second pair subpixel region, protruding from a portion of the first metal auxiliary electrode which is positioned between the portion positioned immediately above the connection between the first horizontal barrier rib and the first vertical barrier rib and a portion positioned immediately above a connection between the first horizontal barrier rib and the third vertical barrier rib towards the first scan electrode; and a fifth transparent electrode positioned in the isolated subpixel region, protruding from at least a portion of the first metal auxiliary electrode which is positioned adjacently to a grade-separated intersection with the first write electrode on a side of the third write electrode, towards the second scan electrode in parallel to the first write electrode, the first scan electrode includes a second metal auxiliary electrode positioned immediately above the second horizontal barrier rib, extending in the horizontal direction; a third transparent electrode positioned in the first pair subpixel region, protruding from a portion of the second metal auxiliary electrode which is positioned between a portion positioned immediately above a connection between the second horizontal barrier rib and the first vertical barrier rib and a portion positioned immediately above a connection between the second horizontal barrier rib and the second vertical barrier rib towards the sustain electrode; and a fourth transparent electrode positioned in the second pair subpixel region, protruding from a portion of the second metal auxiliary electrode which is positioned between the portion positioned immediately above the connection between the second horizontal barrier rib and the first vertical barrier rib and a portion positioned immediately above the connection between the second horizontal barrier rib and the third vertical barrier rib towards the sustain electrode, the second scan electrode includes a third metal auxiliary electrode positioned immediately above the third horizontal barrier rib, extending in the horizontal direction; and a sixth transparent electrode positioned in the isolated subpixel region, protruding from at least a portion of the third metal auxiliary electrode which is positioned adjacently to a grade-separated intersection with the first write electrode on a side of the second write electrode, towards the sustain electrode in parallel to the first write electrode, the third transparent electrode is positioned immediately above the second write electrode and a vertical direction central axis of the third transparent electrode is positioned on a side of the second vertical barrier rib from a vertical direction central axis of the first pair subpixel region, and the fourth transparent electrode is positioned immediately above the third write electrode and a vertical direction central axis of the fourth transparent electrode is positioned on a side of the third vertical barrier rib from a vertical direction central axis of the second pair subpixel region.

According to a second aspect of the present invention, in the surface discharge type plasma display panel of the first aspect, the second write electrode includes an extending portion extending in parallel to the vertical direction and including a rectangular cross section; and a protruding portion protruding from a portion of the extending portion which is positioned in the first pair subpixel region towards the first write electrode along the horizontal direction, the third write electrode includes an extending portion extending in parallel to the vertical direction and including a rectangular cross section; and a protruding portion protruding from a portion of the extending portion which is positioned in the second pair subpixel region towards the first write electrode along the horizontal direction, the first transparent electrode extends from a portion of the first metal auxiliary electrode which is positioned adjacently to the portion positioned immediately above the connection between the first horizontal barrier rib and the first vertical barrier rib on a side of the second write electrode in parallel to the vertical direction, and comprises a rectangular cross section, the second transparent electrode extends from a portion of the first metal auxiliary electrode which is positioned adjacently to the portion positioned immediately above the connection between the first horizontal barrier rib and the first vertical barrier rib on a side of the third write electrode in parallel to the vertical direction, and comprises a rectangular cross section, the third transparent electrode extends from a portion of the second metal auxiliary electrode which is positioned adjacently to the portion positioned immediately above the connection between the second horizontal barrier rib and the second vertical barrier rib on a side of the first write electrode, being opposed to a side surface of the first transparent electrode, in parallel to the vertical direction, includes a rectangular cross section and is positioned immediately above the protruding portion of the second write electrode, the fourth transparent electrode extends from a portion of the second metal auxiliary electrode which is positioned adjacently to the portion positioned immediately above the connection between the second horizontal barrier rib and the third vertical barrier rib on a side of the first write electrode, being opposed to a side surface of the second transparent electrode, in parallel to the vertical direction, includes a rectangular cross section and is positioned immediately above the protruding portion of the third write electrode, and the first transparent electrode, the second transparent electrode, the third transparent electrode and the fourth transparent electrode include the same shape and same size as each other.

According to a third aspect of the present invention, in the surface discharge type plasma display panel of the second aspect, the fifth transparent electrode protrudes from the grade-separated intersection with the first write electrode, a portion positioned adjacently to the grade-separated intersection on a side of the second write electrode and a portion positioned adjacently to the grade-separated intersection on a side of the third write electrode in the first metal auxiliary electrode, the sixth transparent electrode protrudes from the grade-separated intersection with the first write electrode, a portion positioned adjacently to the grade-separated intersection on a side of the second write electrode and a portion positioned adjacently to the grade-separated intersection on a side of the third write electrode in the third metal auxiliary electrode, a tip portion of the sixth transparent electrode is opposed to a tip portion of the fifth transparent electrode with a predetermined spacing therebetween, the fifth transparent electrode and the sixth transparent electrode include the same shape and same size, and the first write electrode includes an extending portion extending in parallel to the vertical direction and including a rectangular cross section; and a protruding portion protruding from a portion of the extending portion of the first write electrode which is positioned in the isolated subpixel region and immediately below the sixth transparent electrode, towards a portion immediately below a side surface of the sixth transparent electrode along the horizontal direction.

According to a fourth aspect of the present invention, in the surface discharge type plasma display panel of the second aspect, the first write electrode includes an extending portion extending in parallel to the vertical direction and including a rectangular cross section; and a protruding portion protruding from a portion of the extending portion of the first write electrode which is positioned in the isolated subpixel region, towards the second write electrode along the horizontal direction, the fifth transparent electrode protrudes from a portion of the first metal auxiliary electrode which is positioned adjacently to the grade-separated intersection with the first write electrode on a side of one of the second write electrode and the third write electrode, in parallel to the vertical direction, and includes a rectangular cross section, the sixth transparent electrode protrudes from a portion of the third metal auxiliary electrode which is positioned adjacently to the grade-separated intersection with the first write electrode on a side of the other one of the second write electrode and the third write electrode, being opposed to a side surface of the fifth transparent electrode, in parallel to the vertical direction, and includes a rectangular cross section, and the fifth transparent electrode and the sixth transparent electrode both include the same shape and same size as the first transparent electrode.

According to a fifth aspect of the present invention, in the surface discharge type plasma display panel of the first aspect, the second write electrode includes an extending portion extending in parallel to the vertical direction and including a rectangular cross section, a portion of the extending portion of the second write electrode which is positioned in the first pair subpixel region is positioned between a first opposed side surface of the first vertical barrier rib and an opposed side surface of the second vertical barrier rib, being closer to the opposed side surface of the second vertical barrier rib, the third write electrode includes an extending portion extending in parallel to the vertical direction and including a rectangular cross section, a portion of the extending portion of the third write electrode which is positioned in the second pair subpixel region is positioned between a second opposed side surface of the first vertical barrier rib which is opposite to the first opposed side surface and an opposed side surface of the third vertical barrier rib, being closer to the opposed side surface of the third vertical barrier rib, the first transparent electrode and the third transparent electrode are each positioned immediately above the portion in the extending portion of the second write electrode which is positioned in the first pair subpixel region, and each include a rectangular cross section, a tip portion of the first transparent electrode is opposed to a tip portion of the third transparent electrode with a predetermined spacing therebetween, the second transparent electrode and the fourth transparent electrode are each positioned immediately above the portion in the extending portion of the third write electrode which is positioned in the second pair subpixel region, and each include a rectangular cross section, a tip portion of the second transparent electrode is opposed to a tip portion of the fourth transparent electrode with a predetermined spacing therebetween, and the first transparent electrode, the second transparent electrode, the third transparent electrode and the fourth transparent electrode include the same shape and same size as each other.

According to a sixth aspect of the present invention, in the surface discharge type plasma display panel of the fifth aspect, the fifth transparent electrode protrudes from the grade-separated intersection with the first write electrode, a portion positioned adjacently to the grade-separated intersection on a side of the second write electrode and a portion positioned adjacently to the grade-separated intersection on a side of the third write electrode in the first metal auxiliary electrode, the sixth transparent electrode protrudes from the grade-separated intersection with the first write electrode, a portion positioned adjacently to the grade-separated intersection on a side of the second write electrode and a portion positioned adjacently to the grade-separated intersection on a side of the third write electrode in the third metal auxiliary electrode, a tip portion of the sixth transparent electrode is opposed to a tip portion of the fifth transparent electrode with a predetermined spacing therebetween, and the fifth transparent electrode and the sixth transparent electrode each include the same shape and same size as the first transparent electrode.

According to a seventh aspect of the present invention, in the surface discharge type plasma display panel of the sixth aspect, each of the first transparent electrode, the second transparent electrode, the third transparent electrode and the fourth transparent electrode, includes a protruding portion protruding from the tip portion and its vicinity towards the first write electrode by a first protrusion distance in the horizontal direction, keeping the predetermined spacing with the opposed transparent electrode, and the first transparent electrode, the second transparent electrode, the third transparent electrode and the fourth transparent electrode each include an L-shaped cross section.

According to an eighth aspect of the present invention, in the surface discharge type plasma display panel of the seventh aspect, each of the fifth transparent electrode and the sixth transparent electrode includes a protruding portion protruding from the tip portion and its vicinity towards both the second write electrode and the third write electrode by a second protrusion distance in the horizontal direction, keeping the predetermined spacing with the opposed transparent electrode, and the fifth transparent electrode and the sixth transparent electrode each include a T-shaped cross section.

The present invention is also intended for a surface discharge type plasma display device. According to a ninth aspect of the present invention, the surface discharge type plasma display device includes the surface discharge type plasma display panel of the first aspect; and a driver configured to generate a signal for driving the surface discharge plasma display panel.

The present invention is further intended for a front panel used in the surface discharge type plasma display panel of the first aspect. According to a tenth aspect of the present invention, the front panel includes the front substrate; the sustain electrode; the first scan electrode; the second scan electrode; and the dielectric layer.

According to the first, second, fifth, ninth and tenth aspects of the present invention, since both the third transparent electrode in the first pair subpixel region and the fourth transparent electrode in the second pair subpixel region are disposed further away from the first write electrode for selecting the isolated subpixel region, when the isolated subpixel region is selected and both the pair subpixel regions are not selected, a wrong discharge hardly occurs in the pair subpixel regions and as a result, there arises an effect of increasing a writing voltage margin.

According to the third aspect of the present invention, it is possible to more easily cause a writing discharge between the first write electrode and the sixth transparent electrode in the isolated subpixel region.

According to the fourth and sixth aspects of the present invention, since the writing voltage margins of the subpixels are made equal, it is possible to further increase the whole voltage margin.

According to the seventh aspect of the present invention, in each of the pair subpixel regions, it is possible to suppress deviation of the center of luminescence intensity distribution from the position of the vertical direction central axis of this region and this makes it more easily to achieve a color separation improvement effect.

According to the eight aspect of the present invention, also in the isolated subpixel region, it is possible to suppress deviation of the center of luminescence intensity distribution from the position of the vertical direction central axis of this region and this makes it more easily to achieve a color separation improvement effect.

These and other objects, features, aspects and advantages of the present invention will become more apparent from the following detailed description of the present invention when taken in conjunction with the accompanying drawings.

BEST MODE FOR CARRYING OUT THE INVENTION

Since an AC drive surface discharge reflection type PDP in accordance with the present invention has an isosceles delta array type pixel, now, discussion will be made first on a structure of the isosceles delta array type pixel and definition of respective subpixels, referring to figures.

Figure 1:
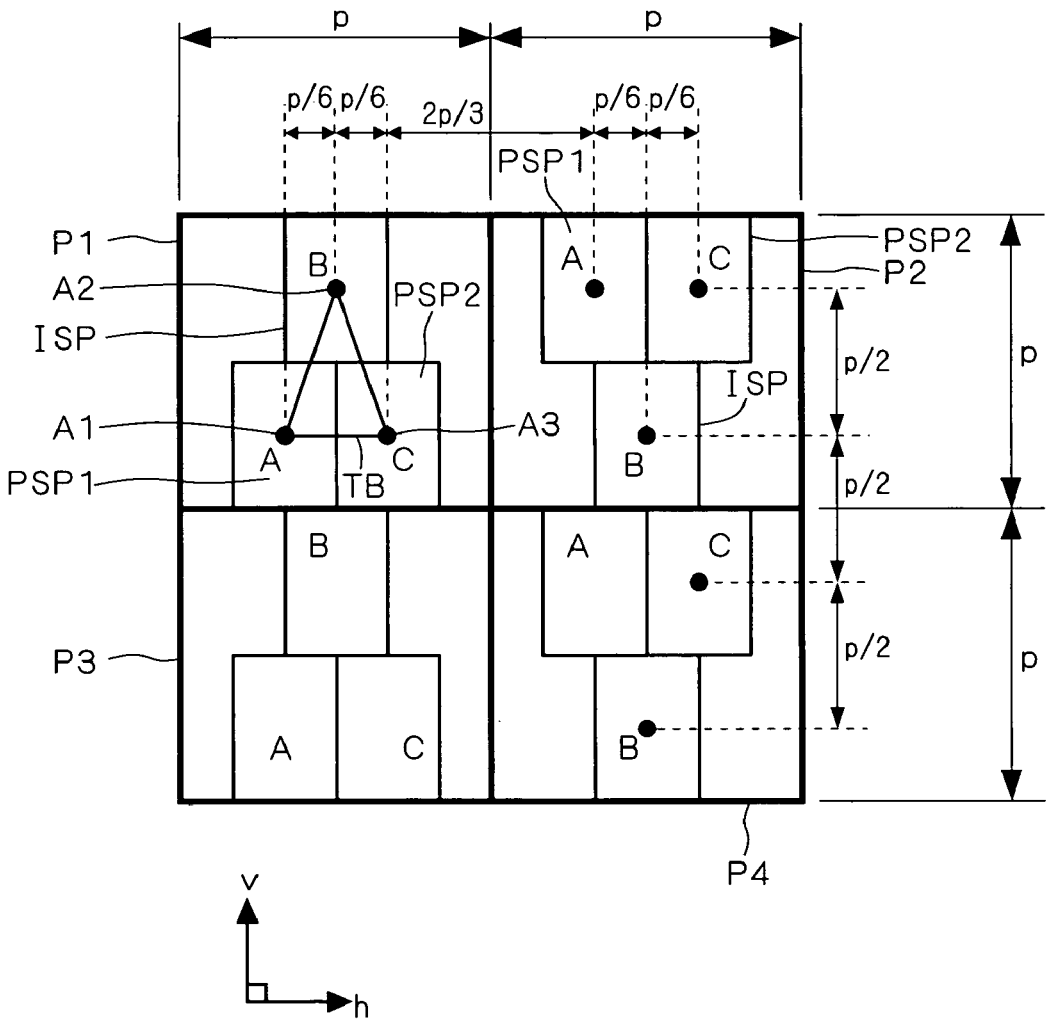
FIG. 1 is a view schematically showing a structure of an isosceles delta array type pixel included in an AC drive surface discharge reflection type PDP in accordance with the present invention.

FIG. 1 is a view schematically showing the structure of the isosceles delta array type pixel. FIG. 1 shows four isosceles delta array type pixels P1, P2, P3 and P4 which are adjacent to one another. The pixels P1 and P3 which are adjacent to each other in a vertical direction (a second direction) v have the same subpixel array structure, and similarly the pixels P2 and P4 have the same subpixel array structure. Herein, taking the pixel P1 as an example, the structure of the pixels P1, P2, P3 and P4 will be described.

As shown in FIG. 1, a pixel P1 represented as a square having a pitch p is constituted of three subpixels PSP1, PSP2 and ISP, and center points of these subpixels PSP1, PSP2 and ISP are disposed at vertices A1, A3 and A2 of an isosceles triangle, respectively. Among these subpixels, two subpixels PSP1 and PSP2 positioned at the vertices A1 and A3 constituting a base TB of the isosceles triangle are defined as "pair subpixels". In particular, a first subpixel PSP1 having a center point positioned at one vertex A1 which is an constituent of the base TB of the isosceles triangle is referred to as a "first pair subpixel A" and a third subpixel PSP2 having a center point positioned at the other vertex A3 which is another constituent of the above base TB is referred to as a "second pair subpixel C". Further, a second subpixel ISP having a center point positioned at the remaining one vertex A2 of the isosceles triangle which is opposed to the above base TB is defined as an "isolated subpixel B".

Though each of the first pair subpixel A, the isolated subpixel B and the second pair subpixel C corresponds to a subpixel emitting any one of three primary colors, i.e., red (R), green (G) and blue (B), a color represented by each subpixel is not particularly described in the present specification, from viewpoint of generalization. Further, for example, if the colors of the subpixels A, B and C are R, G and B, respectively, a color arrangement consisting of (R, G, B, R, G, B) in a horizontal direction (first direction) h orthogonal to a vertical direction (second direction) v inside a display surface.

Furthermore, by inverting the respective positions of the first pair subpixel A and the second pair subpixel C in a pixel P2 of FIG. 1, the subpixel array structure of a pixel P2 can be made the same as that of the pixel P1.

The First Preferred Embodiment

<Structure of Panel>

Figure 2:
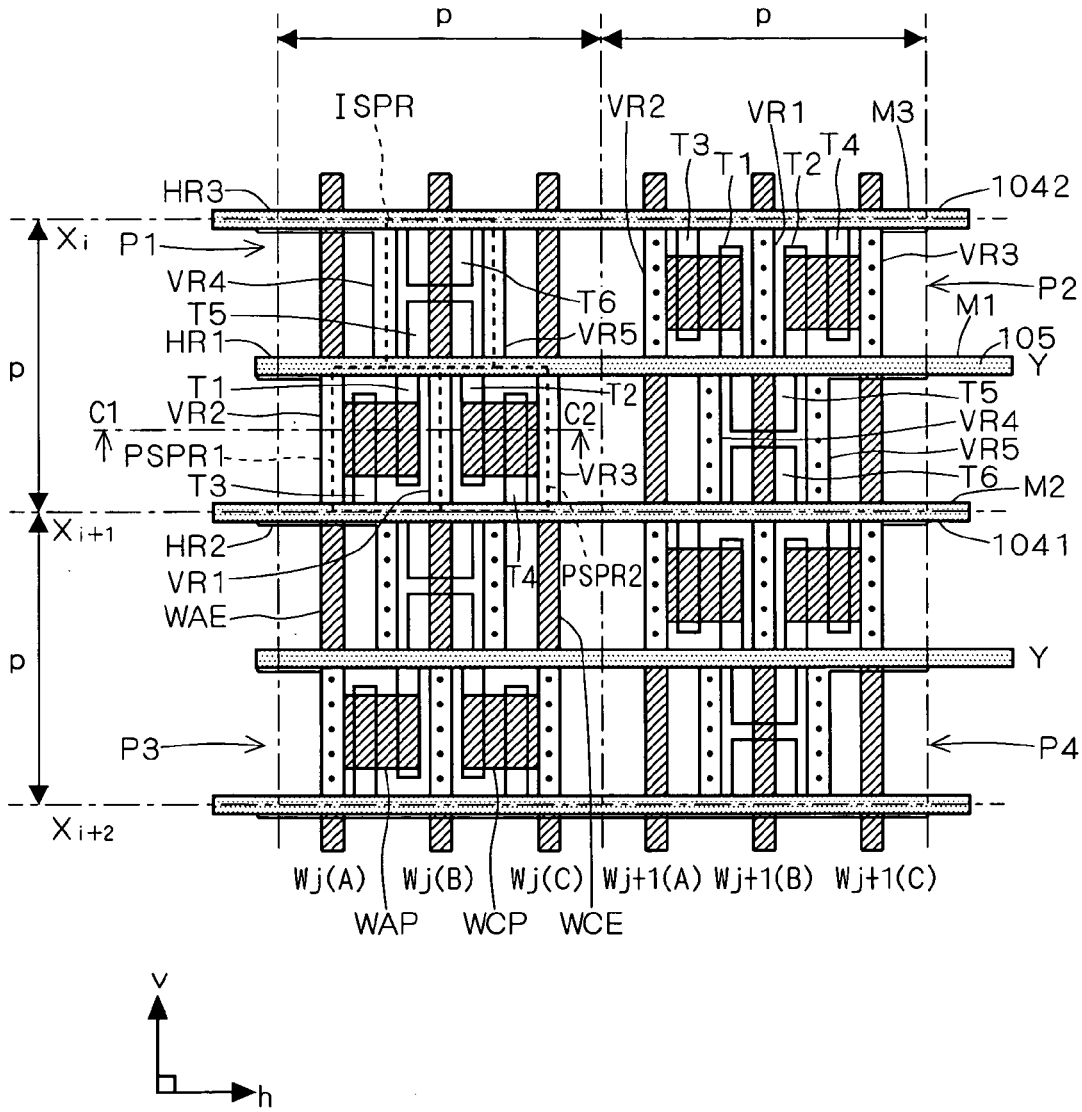
FIG. 2 is a perspective plan view showing a structure of an AC drive surface discharge reflection type PDP in accordance with a first preferred embodiment as viewed from a display surface side.

FIG. 2 is a perspective plan view showing a structure of the AC drive surface discharge reflection type PDP in accordance with the present preferred embodiment as viewed from a display surface side, and for convenience of illustration, enlargedly shows only a structure consisting of four pixels P1, P2, P3 and P4 which are adjacent to one another. Specifically, FIG. 2 shows a positional relation of an X electrode (also referred to as a scan electrode) and a Y electrode (also referred to as a sustain electrode or a common electrode) which form a pair of electrodes, a W electrode (also referred to as a data electrode or a write electrode) and a barrier rib (also referred to simply as a rib). Herein, the pixels P1, P2, P3 and P4 of FIG. 2 correspond to the isosceles delta array type pixels P1, P2, P3 and P4 of FIG. 1, respectively. Therefore, each of the pixels P1, P2, P3 and P4 is constituted of two pair subpixels PSP1 (A) and PSP2 (C) and one isolated subpixel ISP (B).

A function of each electrode in the subfield gradation method will be briefly discussed below. First, the X electrode (Xi, Xi+1, Xi+2, etc) is an electrode to which a scan pulse is applied for each row in a writing period of each subfield. A Y electrode is an electrode for generating a sustain discharge between itself and the X electrode in a sustain discharge period of each subfield. A W electrode (Wj(A), Wj(B), Wj(C), etc) is an electrode to which a data pulse indicating selection/non-selection for color of each row is applied in a writing period of each subfield. In FIG. 2 and the following figures, when the electrodes are shown correspondingly to the first, second and third subpixels A, B and C, signs parenthesizing the reference signs (A, B, C) representing the corresponding subpixels are attached to respective reference signs for the electrodes. For example, a W electrode of the first subpixel A belonging to the j-th column is represented by Wj(A).

Figure 3:
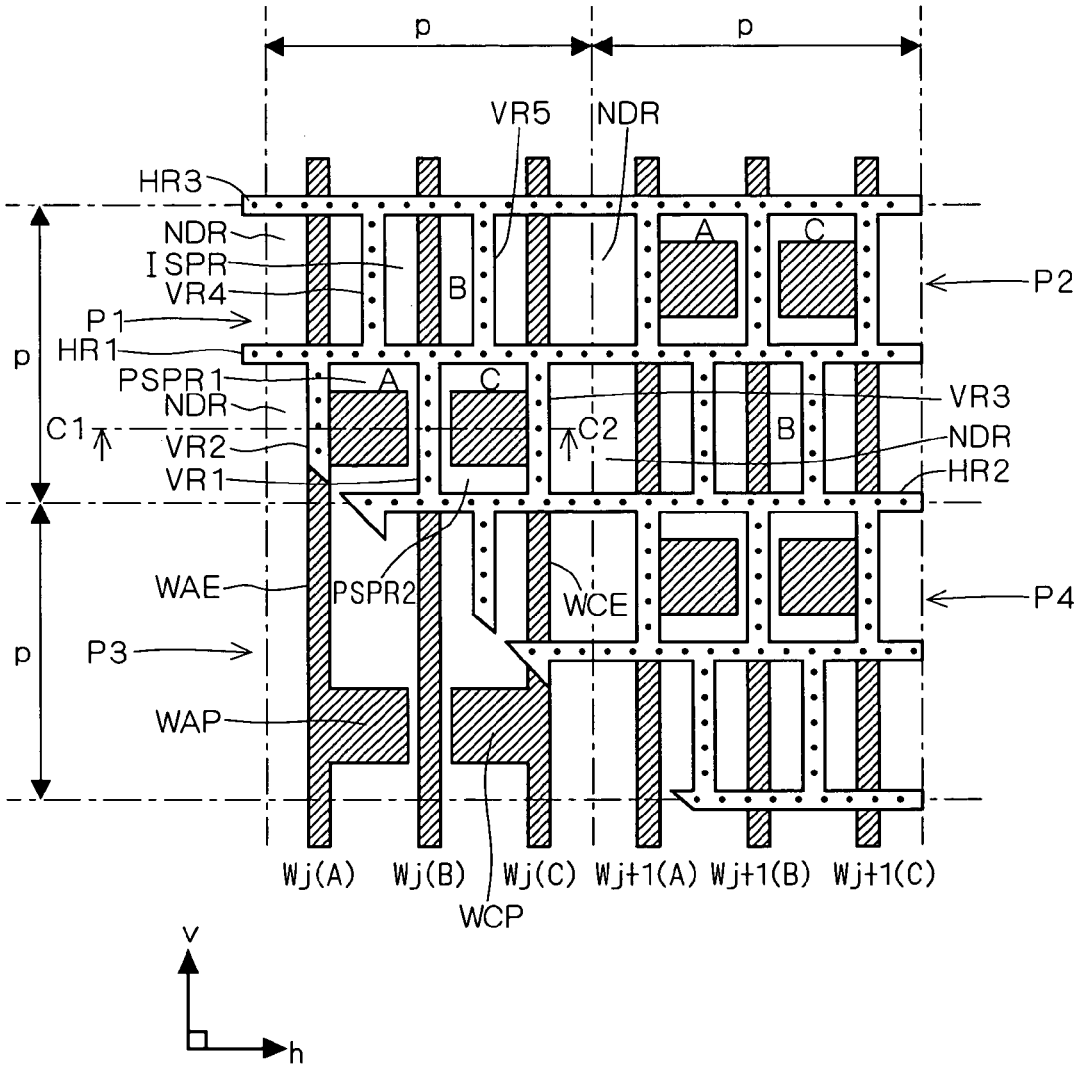
FIG. 3 is a perspective plan view showing a relation between write electrodes and ribs as viewed from the display surface side.
Figure 4:
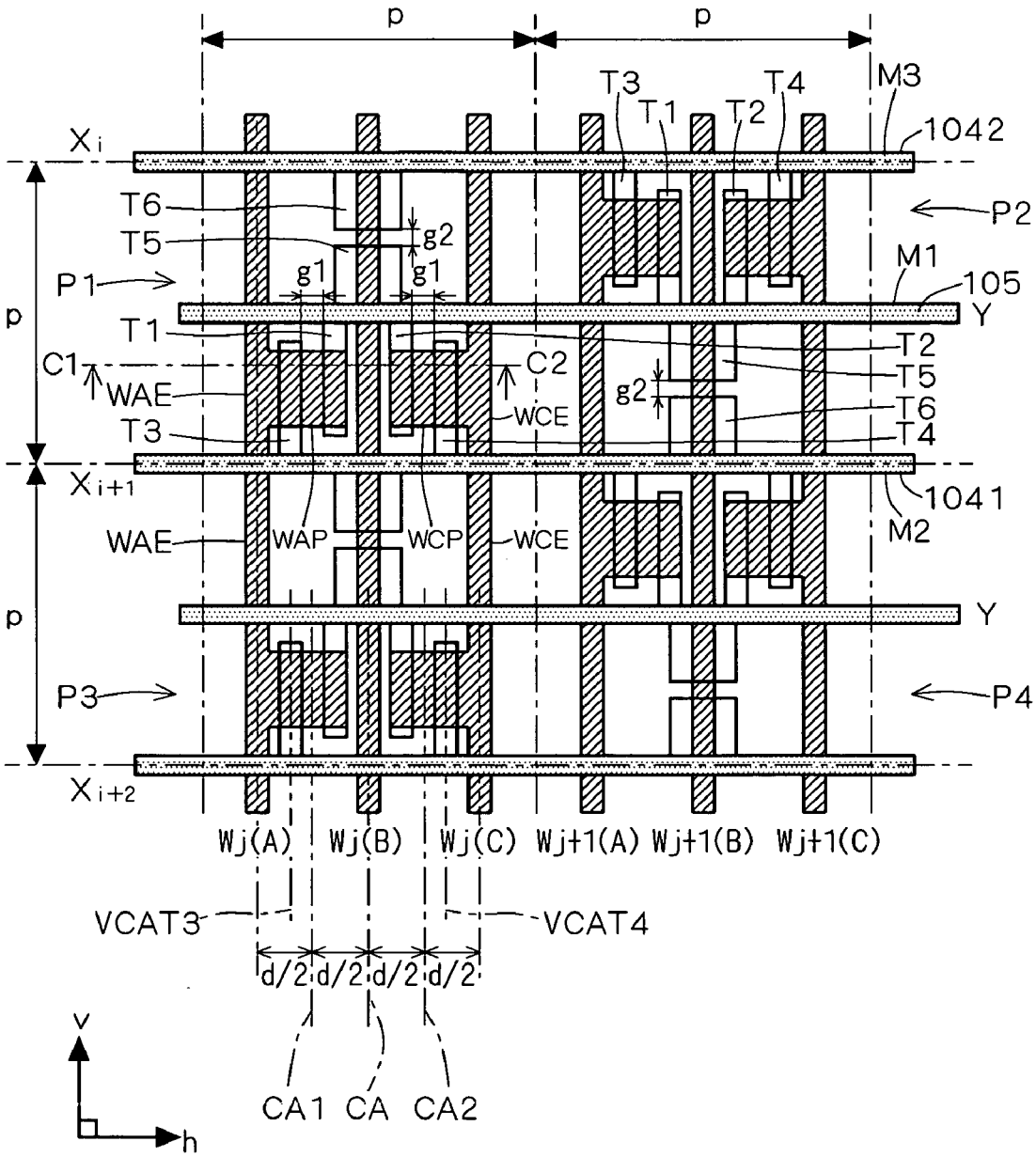
FIG. 4 is a perspective plan view showing a relation between the write electrodes and X electrodes and Y electrodes as viewed from the display surface side.
Figure 5:
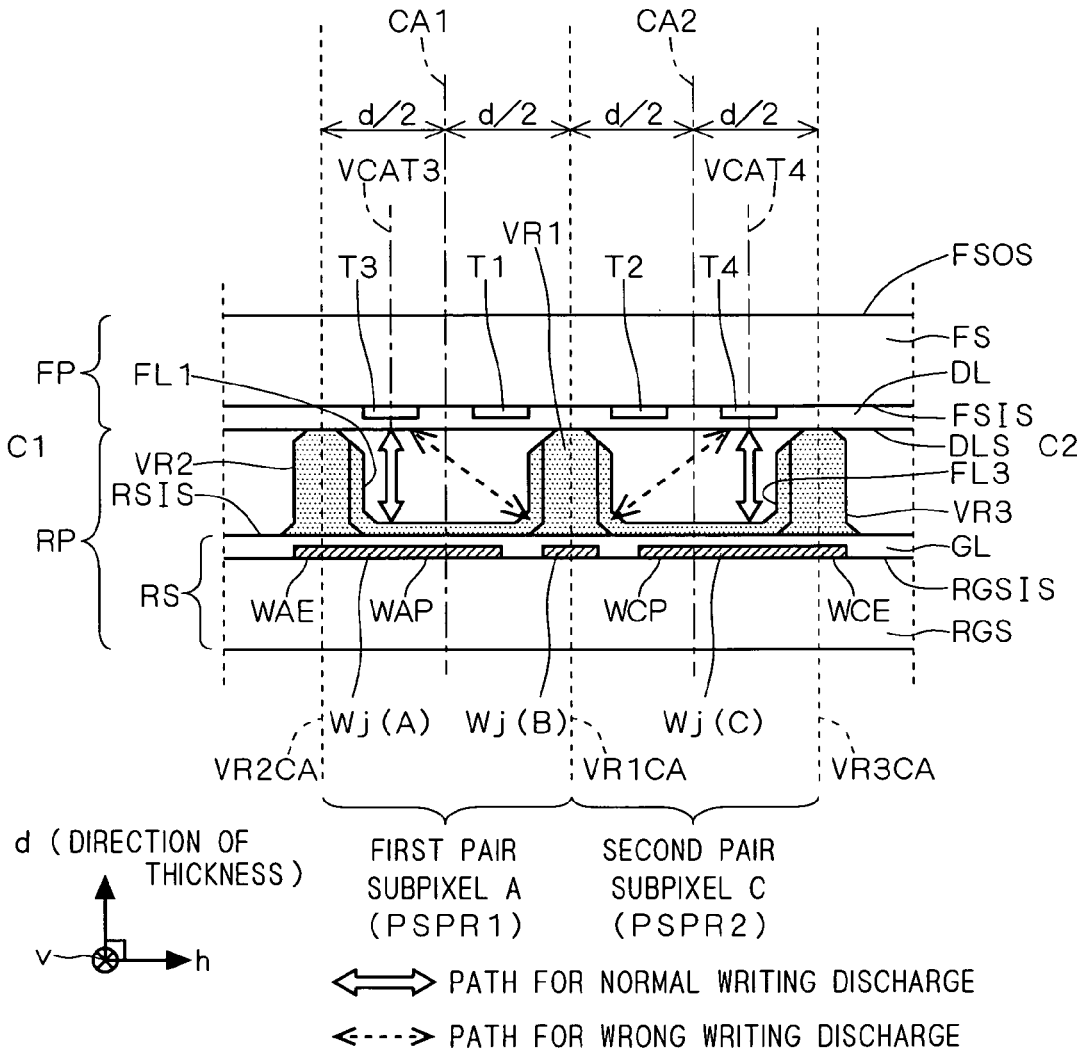
FIG. 5 is a longitudinal section showing a structure of first and second pair subpixel regions.
Figure 6:
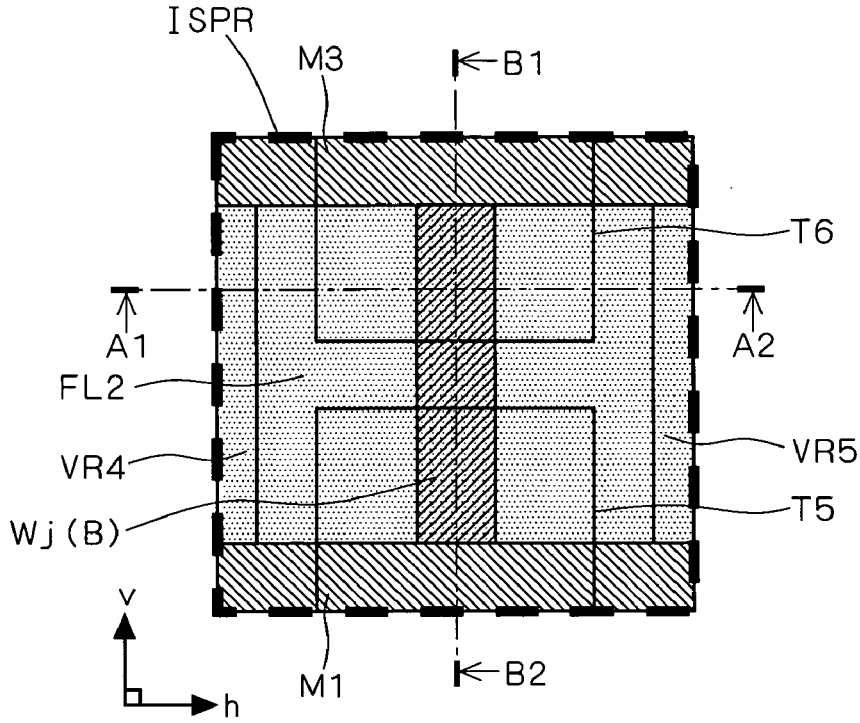
FIG. 6 is a perspective plan view enlargedly showing an isolated subpixel region.
Figure 7:
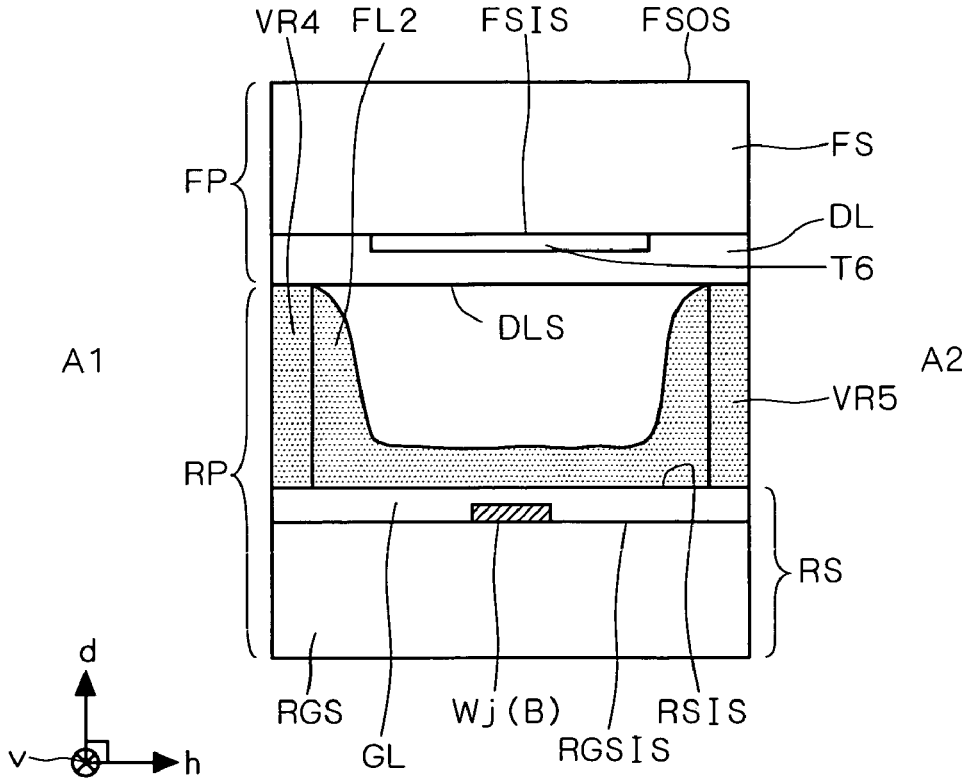
FIGS. 7 and 8 are longitudinal sections showing a structure of the isolated subpixel region.
Figure 8:
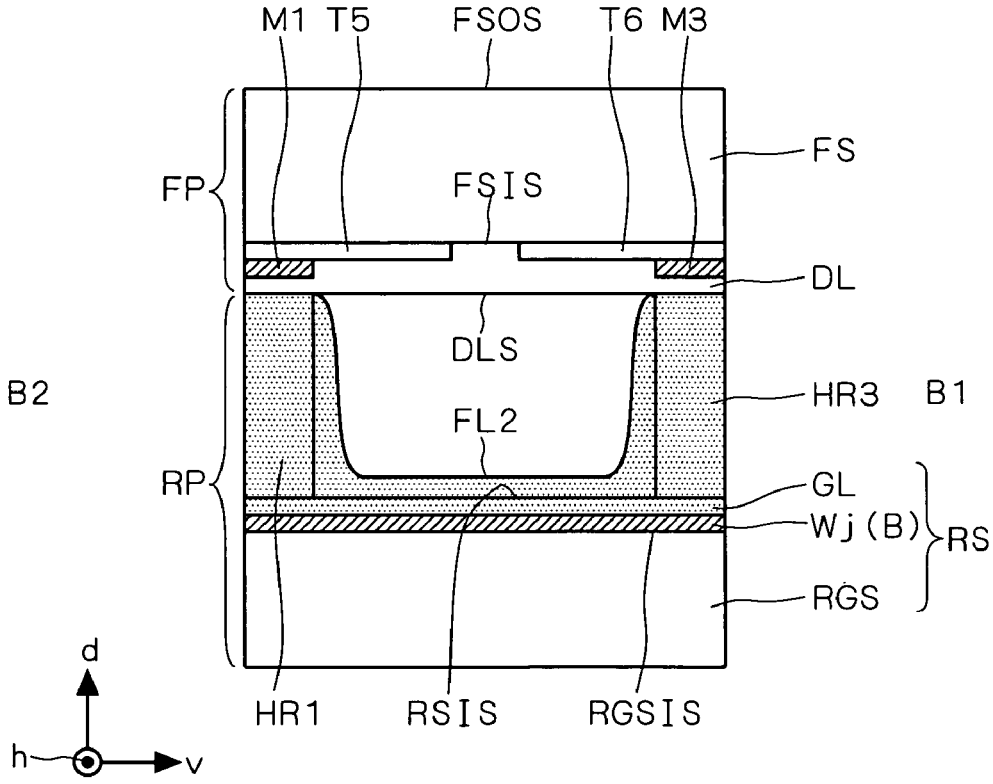

FIG. 3 is a perspective plan view showing a relation between W electrodes and ribs of FIG. 2, and FIG. 4 is a perspective plan view showing a relation between the W electrodes and X electrodes and Y electrodes of FIG. 2. FIG. 5 is a longitudinal section taken along the line C1–C2 of FIG. 2. FIG. 6 is a perspective plan view enlargedly showing an isolated subpixel region ISPR of FIG. 2. FIG. 7 is a longitudinal section taken along the line A1–A2 of FIG. 6, and FIG. 8 is a longitudinal section taken along the line B1–B2 of FIG. 6.

Hereinafter, referring to FIGS. 2 to 8, taking the structure of the first pixel P1 of FIG. 2 as a typical case, a structure of the AC drive surface discharge reflection type PDP of the present preferred embodiment will be described.

First, the present PDP is roughly constituted of a front panel FP and a rear panel RP which are sealed by peripheries. The front panel FP includes a front glass substrate (also referred to simply as a front substrate) FS, pairs of electrodes each of which consists of the X electrode and the Y electrode and a dielectric layer. Herein, in a case where a protection film such as MgO film is formed on a surface of the dielectric layer, an insulating layer consisting of the protection film and the underlying dielectric layer is defined as a "dielectric layer". On the other hand, the rear panel RP has a rear substrate RS, ribs and phosphor layers. The rear substrate RS is constituted of a rear glass substrate RGS, W electrodes and a glaze layer GL, and in this case, an upper surface of the glaze layer GL corresponds to an inner surface RSIS of a rear substrate RS. In contrast to this, if no glaze layer GL is provided, the inner surface RSIS of the rear substrate RS corresponds to an inner surface of the rear glass substrate RGS and a surface of the respective W electrodes. Hereafter, the constituents will be sequentially described in more detail.

The rear substrate RS has a first write electrode Wj(B) extending in the vertical direction v, a second write electrode Wj(A) and a third write electrode Wj(C) which extend in the vertical direction v, sandwiching the first write electrode Wj(B) therebetween. These write electrodes Wj(A), Wj(B) and Wj(C) are formed on the inner surface RGSIS of the rear glass substrate RGS and covered by the glaze layer GL except an extracting terminal portion (not shown) for external extraction.

The front substrate FS has a peripheral portion (not shown) sealed with a peripheral portion of the rear substrate RS, an outer surface FSOS forming a display surface and an inner surface FSIS opposed to the inner surface RSIS of the rear substrate RS.

A discharge space formed between the front glass substrate FS having the above constitution and the rear glass substrate RGS is filled with a discharge gas such as Ne+Xe mixed gas or He+Xe mixed gas under a pressure equal to or lower than the atmospheric pressure.

Next, a group of barrier ribs in the first pixel P1, which is formed like a lattice on the surface of the glaze layer GL, will be described, referring to FIG. 3. The group of lattice barrier ribs performs a function of dividing discharge cells and serves as columns supporting the front panel FP in order to prevent the PDP from being broken by atmospheric pressure.

As shown in FIG. 3, a first horizontal barrier rib HR1 is formed on the inner surface RSIS of the rear substrate RS, extending in parallel to the horizontal direction h orthogonal to the vertical direction v. Further, a second horizontal barrier rib HR2 and a third horizontal barrier rib HR3 are formed on the inner surface RSIS of the rear substrate RS, so extending in parallel to the horizontal direction h as to sandwich the first horizontal barrier rib HR1 therebetween. A spacing between a horizontal direction central axis of the first horizontal barrier rib HR1 (an axis represented by arranged solid circles in FIG. 3) and a horizontal direction central axis of the second horizontal barrier rib HR2 (an axis represented by arranged solid circles in FIG. 3) is a pitch p/2, and similarly a spacing between the horizontal direction central axis of the first horizontal barrier rib HR1 and a horizontal direction central axis of the third horizontal barrier rib HR3 (an axis represented by arranged solid circles in FIG. 3) is also a pitch p/2. Further, these horizontal barrier ribs HR1, HR2 and HR3 are formed across all the pixels aligned in the horizontal direction h. In FIG. 3, the horizontal barrier ribs HR1, HR2 and HR3 are formed across the first and second pixels P1 and P2.

On the other hand, a first vertical barrier rib VR1 is formed on a portion of the inner surface RSIS of the glaze layer GL which is positioned immediately above the first write electrode Wj(B), extending in parallel to the vertical direction v and connecting the first and second horizontal barrier ribs HR1 and HR2 to each other.

Further, a second vertical barrier rib VR2 and a third vertical barrier rib VR3 are formed on the inner surface RSIS of the glaze layer GL, so extending in parallel to the vertical direction v as to sandwich the first vertical barrier rib VR1 therebetween and connecting the first and second horizontal barrier ribs HR1 and HR2 to each other. A spacing between a vertical direction central axis of the first vertical barrier rib VR1 (an axis represented by arranged solid circles in FIG. 3) and a vertical direction central axis of the second vertical barrier rib VR2 (an axis represented by arranged solid circles in FIG. 3) and a spacing between the vertical direction central axis of the first vertical barrier rib VR1 and a vertical direction central axis of the third vertical barrier rib VR3 (an axis represented by arranged solid circles in FIG. 3) are each a pitch d(=p/3) (see FIGS. 1 and 4).

Furthermore, a fourth vertical barrier rib VR4 is formed on a portion of the inner surface RSIS of the rear substrate RS which is positioned between the first write electrode Wj(B) and the second write electrode Wj(A), extending in parallel to the vertical direction v and connecting the first and third horizontal barrier ribs HR1 and HR3 to each other. Additionally, a fifth vertical barrier rib VR5 is formed on a portion of the inner surface RSIS of the rear substrate RS which is positioned between the first write electrode Wj(B) and the third write electrode Wj(C), so extending in parallel to the vertical direction v as to be opposed to the fourth vertical barrier rib VR4 and connecting the first and third horizontal barrier ribs HR1 and HR3 to each other. A spacing between a vertical direction central axis of the fourth vertical barrier rib VR4 (an axis represented by arranged solid circles in FIG. 3) and a vertical direction central axis of the fifth vertical barrier rib VR5 (an axis represented by arranged solid circles in FIG. 3) is a pitch d.

In the second pixel P2, the horizontal barrier rib HR2 corresponds to "the third horizontal barrier rib" and the horizontal barrier rib HR3 corresponds to "the second horizontal barrier rib".

Further, each of the vertical barrier ribs VR1 to VR5 may have a shape with bends, extending in parallel to the vertical direction v, instead of straightly extending (for example, a shape of barrier rib shown in FIG. 1 of Asia Display/IDW'01, pp. 865–868).

Here, the "isolated subpixel region ISPR" is defined as a three-dimensional region which is prescribed or surrounded by the vertical direction central axis of the fourth vertical barrier rib VR4, the vertical direction central axis of the fifth vertical barrier rib VR5, the horizontal direction central axis of the first horizontal barrier rib HR1 and the horizontal direction central axis of the third horizontal barrier rib HR3. This region ISPR forms the isolated subpixel ISP of FIG. 1. In this region ISPR, the first write electrode Wj(B) is provided and a vertical direction central axis of this electrode Wj (B) and a vertical direction central axis of the isolated subpixel region ISPR are coincident with each other. Further, a second phosphor layer FL2 is formed on the inner surface RSIS of the glaze layer GL at least in the isolated subpixel region ISPR. Here, the second phosphor layer FL2 is entirely formed on side surfaces of the barrier ribs VR4, VR5, HR1 and HR3 which define or surround the isolated subpixel region ISPR and the inner surface RSIS of the glaze layer GL in the isolated subpixel region ISPR.

Furthermore, the "second pair subpixel region PSPR2" is defined as a three-dimensional region which is prescribed or surrounded by the vertical direction central axis of the first vertical barrier rib VR1, the vertical direction central axis of the third vertical barrier rib VR3, the horizontal direction central axis of the first horizontal barrier rib HR1 and the horizontal direction central axis of the second horizontal barrier rib HR2. This region PSPR2 forms the second pair subpixel PSP2 of FIG. 1. In this region PSPR2, the third write electrode Wj(C) is provided. Additionally, a third phosphor layer FL3 is formed on the inner surface RSIS of the glaze layer GL at least in the second pair subpixel region PSPR2. Here, the third phosphor layer FL3 is entirely formed on side surfaces of the barrier ribs VR1, VR3, HR1 and HR2 which define or surround the second pair subpixel region PSPR2 and the inner surface RSIS of the glaze layer GL in the second pair subpixel region PSPR2.

Furthermore, the "second pair subpixel region PSPR2" is defined as a three-dimensional region which is prescribed or surrounded by the vertical direction central axis of the first vertical barrier rib VR1, the vertical direction central axis of the third vertical barrier rib VR3, the horizontal direction central axis of the first horizontal barrier rib HR1 and the horizontal direction central axis of the second horizontal barrier rib HR2. This region PSPR2 forms the second pair subpixel PSP2 of FIG. 1. In this region PSPR2, the third write electrode Wj(C) is provided. Additionally, a third phosphor layer FL3 is formed on the inner surface RSIS of the glaze layer GL at least in the second pair subpixel region PSPR2. Here, the third phosphor layer FL3 is entirely formed on side surfaces of the barrier ribs VR1, VR3, HR1 and HR2 which define or surround the second pair subpixel region PSPR2 and the inner surface RSIS of the glaze layer GL in the second pair subpixel region PSPR1.

The reference sign NDR of FIG. 3 represents a non-discharge region in which no surface discharge is generated, which forms a non-discharge cell. In the non-discharge regions NDR of the first pixel P1 each of which is positioned adjacently to the isolated subpixel region ISPR, extending portions WAE and WCE of the second and third write electrodes Wj(A) and Wj(C), respectively, are provided. Further, a black layer (not shown) for suppressing reflection of extraneous light may be provided in a portion of the front panel FP which is positioned immediately above the non-discharge region NDR (e.g., on the inner surface FSIS of the front substrate FS which is positioned immediately above the non-discharge region NDR).

Next, detailed description will be made on a structure of each of the write electrodes Wj(A), Wj(B) and Wj(C), referring to FIGS. 2, 3 and 4.

First, the first write electrode Wj(B) consists only of an extending portion extending in parallel to the vertical direction v and having a rectangular cross section and its vertical direction central axis corresponds to the vertical direction central axis of the first vertical barrier rib VR1.

Next, the second write electrode Wj(A) consists of (1) an extending portion WAE extending in parallel to the vertical direction v and having a rectangular cross section and (2) a protruding portion WAP. Among these constituents, a vertical direction central axis of the extending portion WAE corresponds to the vertical direction central axis of the second vertical barrier rib VR2. The protruding portion WAP protrudes from a portion of the extending portion WAE which is positioned in the first pair subpixel region PSPR1 towards the first write electrode Wj(B) along the horizontal direction h.

Further, the third write electrode Wj(C) consists of (1) an extending portion WCE extending in parallel to the vertical direction v and having a rectangular cross section and (2) a protruding portion WCP. Among these constituents, a vertical direction central axis of the extending portion WCE corresponds to the vertical direction central axis of the third vertical barrier rib VR3. The protruding portion WCP protrudes from a portion of the extending portion WCE which is positioned in the second pair subpixel region PSPR2 towards the first write electrode Wj(B) along the horizontal direction h.

Next, detailed description will be made on the X electrodes (Xi, Xi+1) and the Y electrode in the first pixel P1, referring to FIGS. 2 and 4. The X electrode and Y electrode which forms a pair of electrodes are electrodes contributing to generation of sustain discharge (display discharge) which generates ultraviolet rays.

First, the sustain electrodes (Y electrodes) 105 common to all the pixels are formed on the inner surface FSIS of the front substrate FS, extending in parallel to the horizontal direction h and grade-separately intersecting the second, first and third write electrodes Wj(A), Wj(B) and Wj(C). A spacing between the horizontal direction central axes of adjacent sustain electrodes 105 is a pitch p. The sustain electrode 105 is constituted of (1) a plurality of transparent electrodes each for efficiently extracting visible rays emitted from a corresponding phosphor layer to the display surface and (2) a metal auxiliary electrode (also referred to as a bus electrode) having sufficiently lower resistance than the transparent electrodes, which is provided for supplying a current from an external driving circuit to the transparent electrodes. This will be discussed below in more detail.

Specifically, the sustain electrode 105 has a first metal auxiliary electrode M1 positioned immediately above the first horizontal barrier rib HR1, extending in parallel to the horizontal direction h. Though the first metal auxiliary electrode M1 may be formed directly on the inner surface FSIS of the front substrate FS (the first metal auxiliary electrode M1 is formed on the transparent electrode, however, in a connection point with the transparent electrode as discussed later), it is more preferable, instead, that a horizontal transparent electrode (not shown) positioned immediately above the first horizontal barrier rib HR1, extending in parallel to the horizontal direction h and having the same size in width as the first metal auxiliary electrode M1 is formed directly on the inner surface FSIS of the front substrate FS and the first metal auxiliary electrode M1 is formed, overlapping, on the horizontal transparent electrode.

Further, the sustain electrode 105 has a first transparent electrode T1. The first transparent electrode T1 is positioned in the first pair subpixel region PSPR1 and protrudes from an electrode portion of the first metal auxiliary electrode M1 which is positioned between a portion positioned immediately above connection between the first horizontal barrier rib HR1 and the first vertical barrier rib VR1 and a portion positioned immediately above connection between the first horizontal barrier rib HR1 and the second vertical barrier rib VR2 (closer to the first write electrode Wj(B)) towards a bus electrode of a first scan electrode 1041. Specifically, the first transparent electrode T1 extends from an electrode portion of the first metal auxiliary electrode M1 which is positioned adjacently to the above electrode portion positioned immediately above the connection between the first horizontal barrier rib HR1 and the first vertical barrier rib VR1 on a side of the second write electrode Wj(A), in parallel to the vertical direction v, and has a rectangular cross section.

Furthermore, the sustain electrode 105 has a second transparent electrode T2. The second transparent electrode T2 is positioned in the second pair subpixel region PSPR2 and protrudes from an electrode portion of the first metal auxiliary electrode M1 which is positioned between the electrode portion positioned immediately above the connection between the first horizontal barrier rib HR1 and the first vertical barrier rib VR1 and an electrode portion positioned immediately above connection between the first horizontal barrier rib HR1 and the third vertical barrier rib VR3 (closer to the first write electrode Wj(B)) towards the bus electrode of the first scan electrode 1041. Specifically, the second transparent electrode T2 extends from a portion of the first metal auxiliary electrode M1 which is positioned adjacently to the above electrode portion positioned immediately above the connection between the first horizontal barrier rib HR1 and the first vertical barrier rib VR1 on a side of the third write electrode Wj(C), in parallel to the vertical direction v, and has a rectangular cross section. In other words, the first and second transparent electrodes T1 and T2 are so opposed to each other as to three-dimensionally sandwich the first write electrode Wj(B) therebetween and protrude from the first metal auxiliary electrode M1 by the same length (having the same shape and same size). Moreover, the first and second transparent electrodes T1 and T2 are positioned immediately above the protruding portion WAP of the second write electrode Wj(A) and the protruding portion WCP of the third write electrode Wj(C), respectively.

Further, the sustain electrode 105 has a fifth transparent electrode T5. The electrode T5 is positioned in the isolated subpixel region ISPR. The electrode T5 protrudes from at least an electrode portion of the first metal auxiliary electrode M1 which is positioned adjacently to an electrode portion grade-separately intersecting the first write electrode Wj(B) on a side of the third write electrode Wj(C), in parallel to the first write electrode Wj(B), towards a second scan electrode 1042. Herein, the fifth transparent electrode T5 protrudes from the above electrode portion grade-separately intersecting the first write electrode Wj(B), a portion positioned adjacently to the grade-separated intersection electrode portion on the side of the second write electrode Wj(A) and a portion positioned adjacently to the grade-separated intersection electrode portion on the side of the third write electrode Wj(C) in the first metal auxiliary electrode M1, and a vertical direction central axis of the electrode T5 is coincident with the vertical direction central axis of the first write electrode Wj(B) as the electrode T5 is viewed from a side of the display surface.

On the other hand, the first scan electrode (Xi+1 electrode) 1041 and the second scan electrode (Xi electrode) 1042 are formed on the inner surface FSIS of the front substrate FS, so extending in parallel to the horizontal direction h as to sandwich the sustain electrode 105 therebetween and grade-separately intersecting the first, second and the third write electrodes Wj(B), Wj(A) and Wj(C). These scan electrodes 1041 and 1042, like the sustain electrode 105, each consist of a metal auxiliary electrode and a plurality of transparent electrodes protruding from the metal auxiliary electrode. Though it is preferable that a horizontal transparent electrode (not shown) which extends in parallel to the horizontal direction h and has the same width as the metal auxiliary electrode is formed on the inner surface FSIS and the metal auxiliary electrode is formed, overlapping, on the horizontal transparent electrode, it is not always necessary to form these electrodes thus. There may be a case, for example, where only transparent electrodes protruding in the vertical direction v as described later are formed on the inner surface FSIS, part of the metal auxiliary electrode is formed on the transparent electrodes at connections with the transparent electrodes (formed over the transparent electrodes) and the remaining part of the metal auxiliary electrode is formed directly on the inner surface FSIS. Detailed discussion will be made below on these scan electrodes 1041 and 1042, referring to FIGS. 2 and 4.

In the second pixel P2, the scan electrode 1041 corresponds to the "second scan electrode" and the scan electrode 1042 corresponds to the "first scan electrode".

First, the first scan electrode 1041 has a second metal auxiliary electrode M2 positioned immediately above the second horizontal barrier rib HR2, extending in parallel to the horizontal direction h. A spacing between a horizontal direction central axis of the second metal auxiliary electrode M2 (which corresponds to an axis indicated by an alternate long and short dash line in FIG. 4) and a horizontal direction central axis of a third metal auxiliary electrode M3 described later (which corresponds to an axis indicated by an alternate long and short dash line in FIG. 4) is a pitch p, and a spacing between the horizontal direction central axis of the second metal auxiliary electrode M2 and the horizontal direction central axis of the first metal auxiliary electrode M1 is a pitch p/2.

Further, the first scan electrode 1041 has a third transparent electrode T3 positioned in the first pair subpixel region PSPR1. The electrode T3 protrudes from a portion of the second metal auxiliary electrode M2 which is positioned between the electrode portion positioned immediately above connection between the second horizontal barrier rib HR2 and the first vertical barrier rib VR1 and an electrode portion positioned immediately above connection between the second horizontal barrier rib HR2 and the second vertical barrier rib VR2 (closer to the second write electrode Wj(A)) towards the first metal auxiliary electrode M1 of the sustain electrode 105. Specifically, the third transparent electrode T3 extends from a portion of the second metal auxiliary electrode M2 which is positioned adjacently to the above electrode portion positioned immediately above the above connection between the second horizontal barrier rib HR2 and the second vertical barrier rib VR2 on a side of the first write electrode Wj(B) in parallel to the vertical direction v, being opposed to a side surface of the first transparent electrode T1 which is away therefrom by a first gap g1. The electrode T3 has a rectangular cross section and the same shape and same size as the first transparent electrode T1. Additionally, the electrode T3 is positioned immediately above the protruding portion WAP of the second write electrode Wj(A).

Further, the first scan electrode 1041 has a fourth transparent electrode T4 positioned in the second pair subpixel region PSPR2. The electrode T4 protrudes from a portion of the second metal auxiliary electrode M2 which is positioned between the electrode portion positioned immediately above the connection between the second horizontal barrier rib HR2 and the first vertical barrier rib VR1 and an electrode portion positioned immediately above connection between the second horizontal barrier rib HR2 and the third vertical barrier rib VR3 (closer to the third write electrode Wj(C)) towards the first metal auxiliary electrode Ml of the sustain electrode 105. Specifically, the fourth transparent electrode T4 extends from a portion of the second metal auxiliary electrode M2 which is positioned adjacently to the above electrode portion positioned immediately above the above connection between the second horizontal barrier rib HR2 and the third vertical barrier VR3 on the side of the first write electrode Wj(B) in parallel to the vertical direction v, being opposed to a side surface of the second transparent electrode T2 which is away therefrom by the first gap g1. Moreover, the electrode T4 has a rectangular cross section and the same shape and same size as the second and third transparent electrodes T2 and T3. Therefore, the first transparent electrode T1, the second transparent electrode T2, the third transparent electrode T3 and the fourth transparent electrode T4 have the same shape and same size as each other. Additionally, the electrode T4 is positioned immediately above the protruding portion WCP of the third write electrode Wj(C).

Combination of the first transparent electrode T1 and the third transparent electrode T3 and that of the second transparent electrode T2 and the fourth transparent electrode T4 are axisymmetric with respect to the vertical direction central axis of the first write electrode Wj(B).

A core structure of the present preferred embodiment lies in the following point. Specifically, the third transparent electrode T3 is positioned immediately above the second write electrode Wj(A) and moreover a vertical direction central axis VCAT3 of the third transparent electrode T3 is positioned closer to the second vertical barrier rib VR2 or the extending portion WAE of the second write electrode Wj(A) as viewed from a vertical direction central axis CA1 of the first pair subpixel region PSPR1. Similarly, the fourth transparent electrode T4 is positioned immediately above the third write electrode Wj(C) and moreover a vertical direction central axis VCAT4 of the fourth transparent electrode T4 is positioned closer to the third vertical barrier rib VR3 or the extending portion WCE of the third write electrode Wj(C) as viewed from a vertical direction central axis CA2 of the second pair subpixel region PSPR2.

On the other hand, the second scan electrode 1042 has a third metal auxiliary electrode M3 positioned immediately above the third horizontal barrier rib HR3, extending in parallel to the horizontal direction h. A spacing between a horizontal direction central axis of the third metal auxiliary electrode M3 (which corresponds to an axis indicated by an alternate long and short dash line in FIG. 4) and the horizontal direction central axis of the first metal auxiliary electrode M1 is also half of the pitch p.

Further, the second scan electrode 1042 has a sixth transparent electrode T6 positioned in the isolated subpixel region ISPR. The sixth transparent electrode T6 protrudes from at least a portion of the third metal auxiliary electrode M3 which is positioned adjacently to an electrode portion grade-separately intersecting the first write electrode Wj(B) on the side of the second write electrode Wj(A), in parallel to the first write electrode Wj(B), towards the first metal auxiliary electrode M1 of the sustain electrode 105. Herein, the sixth transparent electrode T6 so protrudes from the above electrode portion grade-separately intersecting the first write electrode Wj(B), a portion positioned adjacently to the grade-separated intersection electrode portion on the side of the second write electrode Wj(A) and a portion positioned adjacently to the grade-separated intersection electrode portion on the side of the third write electrode Wj(C) in the third metal auxiliary electrode M3 as to be opposed to the fifth transparent electrode T5. In other words, a tip portion of the sixth transparent electrode T6 is opposed to a tip portion of the fifth transparent electrode T5 with a second gap g2 (predetermined gap) therefrom. The fifth transparent electrode T5 and the sixth transparent electrode T6 both have the same shape and same size and each have a cross section which is axisymmetric with respect to the vertical direction central axis of the first write electrode Wj(B).

Further, a dielectric layer DL is formed on the inner surface FSIS of the front substrate FS. The discharge space DL covers the sustain electrode 105, the first scan electrode 1041 and the second scan electrode 1042 except extracting terminal portions (not shown) of these electrodes. Moreover, the dielectric layer DL has a surface DLS in contact with respective tops of the first horizontal barrier rib HR1, the second horizontal barrier rib HR2, the third horizontal barrier rib HR3, the first vertical barrier rib VR1, the second vertical barrier rib VR2, the third vertical barrier rib VR3, the fourth vertical barrier rib VR4 and the fifth vertical barrier rib VR5.

Thus, a characteristic feature of the PDP of the present preferred embodiment lies in an arrangement of the first to fourth transparent electrodes T1 to T4 in the first and second pair subpixel regions PSPR1 and PSPR2. This point will be discussed again for summary. As shown in FIG. 5, the transparent electrode portion T3 and the transparent electrode portion T4 are arranged at positions farthest away from the first write electrode Wj(B) in the respective pair subpixels. On the other hand, the transparent electrode portion T1 and the transparent electrode portion T2 are arranged at positions closest to the first write electrode Wj(B)W(b) in the respective subpixels. In order to achieve such a structure, as shown in FIG. 4, the transparent electrode portion T3 and the transparent electrode portion T1 have a positional relation of being opposed to each other with respect to the vertical direction central axis CA1 of the first pair subpixel PSP1. Similarly, the transparent electrode portion T4 and the transparent electrode portion T2 also have a positional relation of being opposed to each other with respect to the vertical direction central axis CA2 of the second pair subpixel PSP2. In other words, the X transparent electrode portion T6 and the Y transparent electrode portion T5 are so arranged as to be opposed to each other with respect to the horizontal direction central axis of the isolated subpixel ISP in the isolated subpixel ISP, and on the other hand, the transparent electrode portion for X electrode and the transparent electrode portion for Y electrode are so arranged to be opposed to each other with respect to the vertical direction central axes CA1 and CA2 of the respective corresponding pair subpixels in the pair subpixels PSP1 and PSP2.

<Variation in Structure>

Hereafter, variation in shape of the W electrode will be discussed, referring to FIG. 9.

(1) In FIG. 4, the first write electrode Wj(B) for selecting the isolated subpixel ISP has a vertical direction central axis CA overlapping the vertical direction central axes of the transparent electrode portion T6 for X electrode and the transparent electrode portion T5 for Y electrode in the isolated subpixel region ISPR and a rectangular cross section, as the present panel is viewed from the side of the display surface FSOS (FIG. 5).

Figure 9:
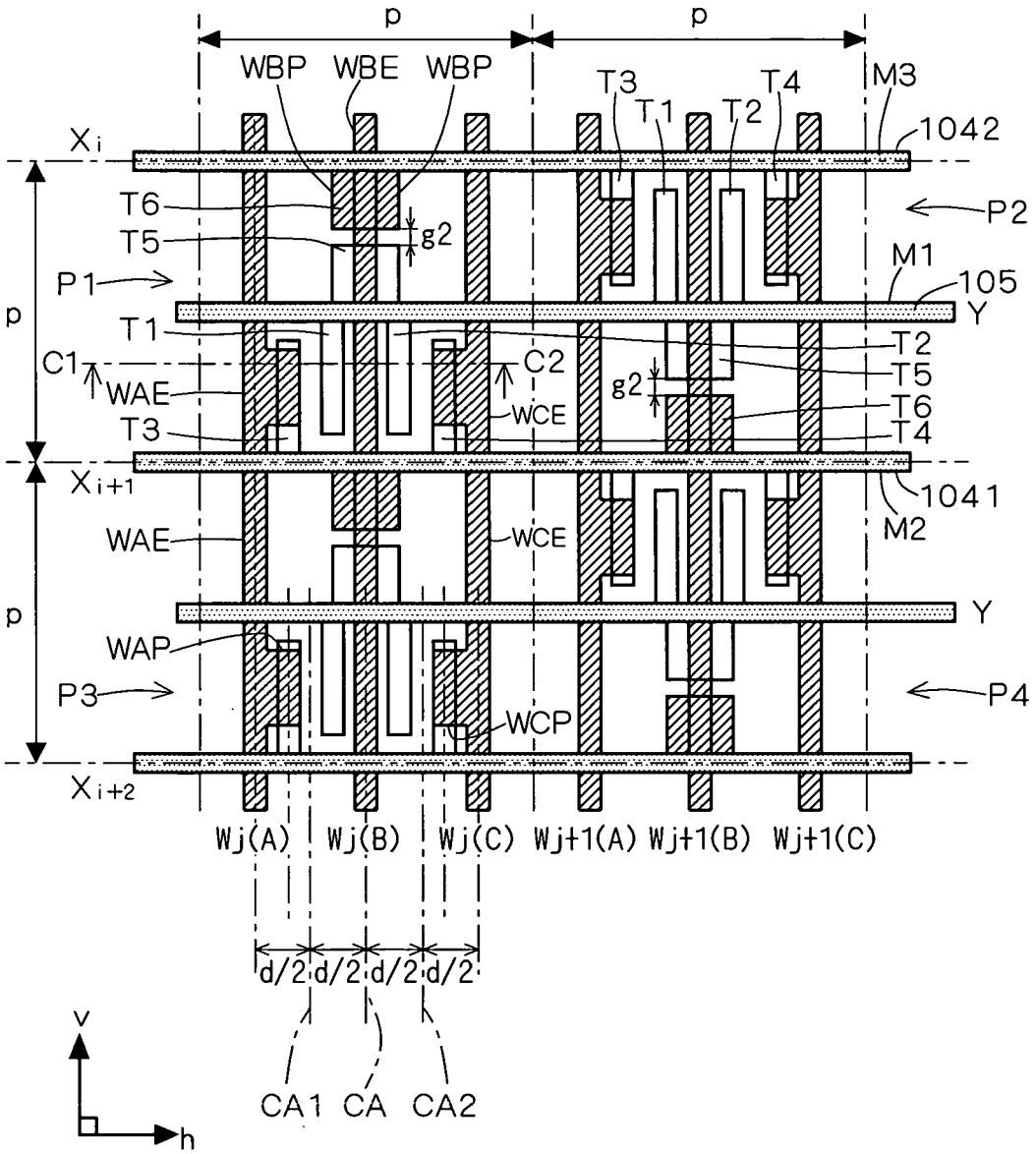
FIG. 9 is a perspective plan view showing a structure of an AC drive surface discharge reflection type PDP in accordance with a variation of the first preferred embodiment as viewed from the display surface side.

Instead of this, in order to more easily cause a writing opposite discharge between the transparent electrode portion T6 for X electrode and the first write electrode Wj(B) in the isolated subpixel region ISPR, as shown in FIG. 9, the first write electrode Wj(B) may have a shape expanding in the horizontal direction h from a portion immediately below the sixth transparent electrode T6.

Specifically, in the first variation, the first write electrode Wj(B) comprises (I) an extending portion WBE extending in parallel to the vertical direction v and having a rectangular cross section and (II) a protruding portion WBP protruding from a portion of the extending portion WBE which is positioned in the isolated subpixel region ISPR and immediately below the sixth transparent electrode T6 towards a portion immediately below a side surface of the sixth transparent electrode T6 along the horizontal direction h.

(2) In FIG. 4, the extending portions WAE and WCE, like trunks, of the second and third write electrodes Wj(A) and Wj(C) for selecting the pair subpixels PSP1 and PSP2 are arranged away from the first write electrode Wj(B) by the same pitch d in the horizontal direction h. Further, in FIG. 4, in order to more easily cause the writing discharge in the pair subpixels, the protruding portions WAP and WCP as branches extend up to portions immediately below the transparent electrode portions T1 and T2 for Y electrode, respectively.

However, if the present invention is more intended to reduce a reactive power, for example, as shown in FIG. 9, the protruding length of the branch electrode portions WAP and WCP may be limited to the length up to portions immediately below the transparent electrode portions T3 and T4 for X electrode from the extending portions, respectively.

<Method of Driving the Panel>

Next, a method of driving the present PDP will be discussed. The characteristic feature of the present preferred embodiment, however, lies in the panel structure and as a driving method used therefor, a conventional driving method can be basically used. Therefore, on the driving method, only a brief discussion will be made to the extent that the functions of the electrodes can be clarified.

In the subfield gradation method, a minimum unit of time for controlling luminescence and non-luminescence of all the cells in one screen is referred to as a "subfield". This subfield is further divided into three periods, i.e., a "reset period", a "writing period" and a "sustain discharge period".

First, in the "reset period", a discharge history of an immediately preceding subfield is reset. Specifically, in the immediately preceding subfield, "wall charges" accumulated on a portion positioned immediately above the X electrode and the Y electrode in the surface DLS of the dielectric layer DL are cancelled by application of voltage.

In the subsequent "writing period", the wall charges are applied only to a cell in which the sustain discharge (display discharge) is generated in the following "sustain discharge period". Specifically, a negative pulse voltage is sequentially applied to the X electrodes by line sequential scan and in accordance with the timing of the pulse voltage, a positive pulse voltage generated on the basis of image data is applied to the W electrodes. With this application of pulse voltage, a "writing opposite discharge" is generated between the X electrode and the W electrode in a desired cell. Further, in the writing period, a positive voltage is always applied to the Y electrode. The voltage applied to the Y electrode in this case is set in advance to such a value as not to cause a discharge between the X electrode and the Y electrode by itself, except a case where a discharge is caused between the X electrode and the Y electrode with the "writing opposite discharge" between the X electrode and the W electrode serving as a trigger discharge. Therefore, when the "writing opposite discharge" is caused between the X electrode and the W electrode, a discharge is caused between paired X electrode and Y electrode with this discharge as a trigger. This discharge is referred to as a "writing surface discharge", and a discharge combining the "writing opposite discharge" and the "writing surface discharge" is referred to as the "writing discharge". With this "writing discharge", positive wall charges are accumulated on the surface of the dielectric layer immediately above the X electrode and on the other hand, negative wall charges are accumulated on the surface of the dielectric layer immediately above the Y electrode.

In the subsequent "sustain discharge period", a voltage in a form of pulse is applied from the outside alternately between the X electrode and the Y electrode. When a voltage obtained by superposing the externally-applied voltage and a voltage generated by the "wall charges" accumulated on the surfaces immediately above the X electrode and the Y electrode in the "writing period" rises to be equal to or higher than a firing voltage, a sustain discharge is caused. Ultraviolet rays generated by this sustain discharge excites the phosphor layers FL1 to FL3 and the ultraviolet rays are changed into visible rays to emit visible lights of respective colors corresponding to the phosphor layers FL1 to FL3.

<Action and Effect of the Panel>

Prior to discussion on the action and effect of the present panel, the action of the above-discussed no-prior art will be further studied as a comparison example.

Figure 10:
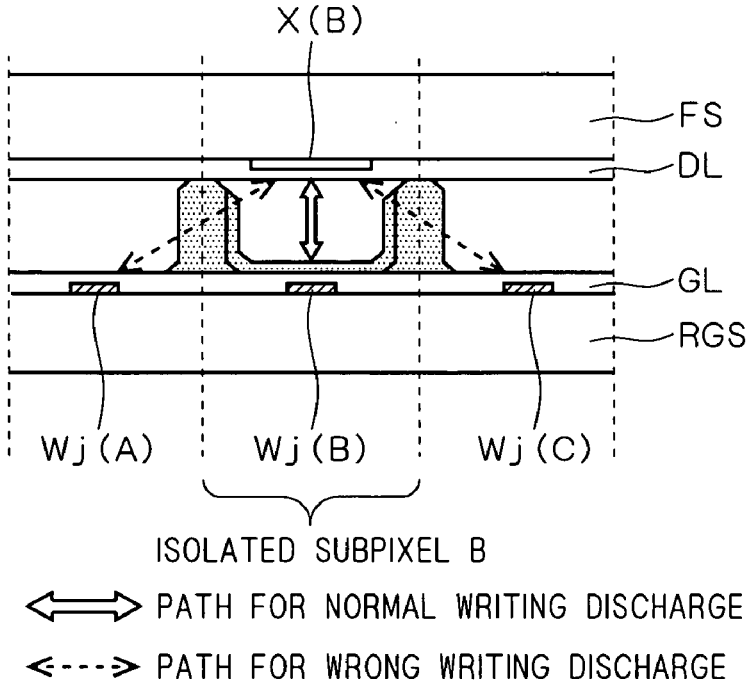
FIGS. 10 and 11 are longitudinal sections showing a problem in no-prior art as a comparison example.
Figure 11:
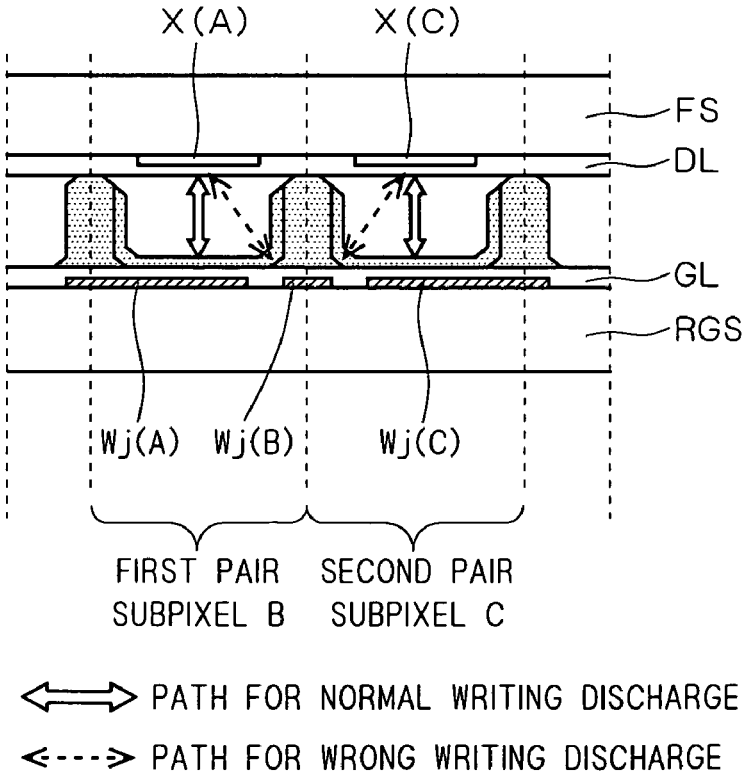

FIG. 10 is a longitudinal section showing an isolated subpixel B, for presenting a problem of the unpublished art (no-prior art). FIG. 11 is a longitudinal section showing first and second pair subpixels A and C, for presenting the problem of the no-prior art.

It is herein assumed, for example, that the firing voltage between an X electrode and a W electrode which are opposed to each other in a subpixel is 200 V. Using a voltage Vxa of scan pulse applied to the X electrode as a parameter, assuming that a voltage Vwa of data pulse applied to the W electrode is 50 V, a minimum voltage Vxa to cause a writing discharge is −150 V.

As can be seen from FIGS. 10 and 11, since the distance between electrodes opposed to each other in a subpixel is smaller than the distance between electrodes opposed to each other across different subpixels, a firing voltage caused by a voltage applied to the electrodes opposed to each other across different subpixels is higher than a firing voltage caused between the electrodes opposed to each other in a subpixel. For example, it is assumed that a firing voltage between the electrode X(B) and the electrode Wj(A) and a firing voltage between the electrode X(B) and the electrode Wj(C) are each 250 V. In this case, when the subpixels A and C are selected and the subpixel B is not selected, if the voltage Vwa is 50 V, a minimum voltage Vxa to cause a wrong discharge between the electrode X(B) and the electrode Wj(A) and between the electrode X(B) and the electrode Wj(C) is −200 V. In this case, a margin of the voltage Vxa is 50 V which corresponds to a voltage range from −150 V to −200 V.

On the other hand, when the subpixels A and C are not selected and the subpixel B is selected, if the distance between the electrode X(A) and the electrode Wj(B) and the distance between the electrode X(C) and the electrode Wj(B) are equal to the distance between the electrode X(B) and the electrode Wj(A) and the distance between the electrode X(B) and the electrode Wj(C), the minimum voltage Vxa to cause a wrong discharge between the electrode X(A) and the electrode Wj(B) and between the electrode X(C) and the electrode Wj(B) is −200 V and the voltage margin is 50 V.

In the isosceles delta array AC surface discharge type PDP of the no-prior art (the precedent and unpublished art), however, the distance between the electrode X(A) and the electrode Wj(B) and the distance between the electrode X(C) and the electrode Wj(B) are smaller than the distance between the electrode X(B) and the electrode Wj(A) and the distance between the electrode X(B) and the electrode Wj(C). Therefore, when the subpixels A and C are not selected and the subpixel B is selected, disadvantageously, the minimum voltage Vxa to cause a wrong discharge between the electrode X(A) and the electrode Wj(B) and between the electrode X(C) and the electrode Wj(B) is lower than −200 V and the writing voltage margin is lower than 50 V. Since a firing voltage in the writing discharge varies with time, it is preferable that the writing voltage margin should be large.

In contrast to this, in the present preferred embodiment, such a problem does not arise. Specifically, as is clear from FIG. 5 schematically showing distances in discharge paths, an electric field between the transparent electrode portion T3 for X electrode and the first write electrode Wj(B) and that between the transparent electrode portion T4 for X electrode and the first write electrode Wj(B) are weakened by an increase in distance between these transparent electrodes T3 and T4 and the first write electrode Wj(B) as compared with the no-prior art (the precedent and unpublished art) shown in FIGS. 10 and 11. Therefore, a firing voltage of wrong discharge which can be caused by the voltage applied to the first write electrode Wj(B) rises in the first pair subpixel A and the second pair subpixel C and as a result, it is possible to increase the writing voltage margin.

On the other hand, since a positive potential is applied to the Y electrode 105, like the first write electrode Wj(B), in the writing period, the difference in potential between the transparent electrode portion T1 for Y electrode and the transparent electrode portion T2 for Y electrode and the first write electrode Wj(B) is small. Therefore, even if the first write electrode Wj(B) and the first and second transparent electrodes T1 and T2 becomes closer to each other, no wrong writing discharge is caused between the first write electrode Wj(B) and the Y electrode 105 in the writing period.

The Second Preferred Embodiment

<Point of Notice>

In the first preferred embodiment, the shapes of the X electrode, Y electrode and the W electrode in the isolated subpixel region and the shapes of the X electrode, Y electrode and the W electrode in the pair subpixel regions are different from each other. However, when the shapes of electrodes are different among subpixels, the voltage margins become different among the subpixels and a whole margin which is an overlap of the margins in the subpixels necessarily becomes smaller, as compared with a case where the shapes of the electrodes are equal in all the subpixels. An object of the second preferred embodiment is intended to solve this problem.

<Structure>

Figure 12:
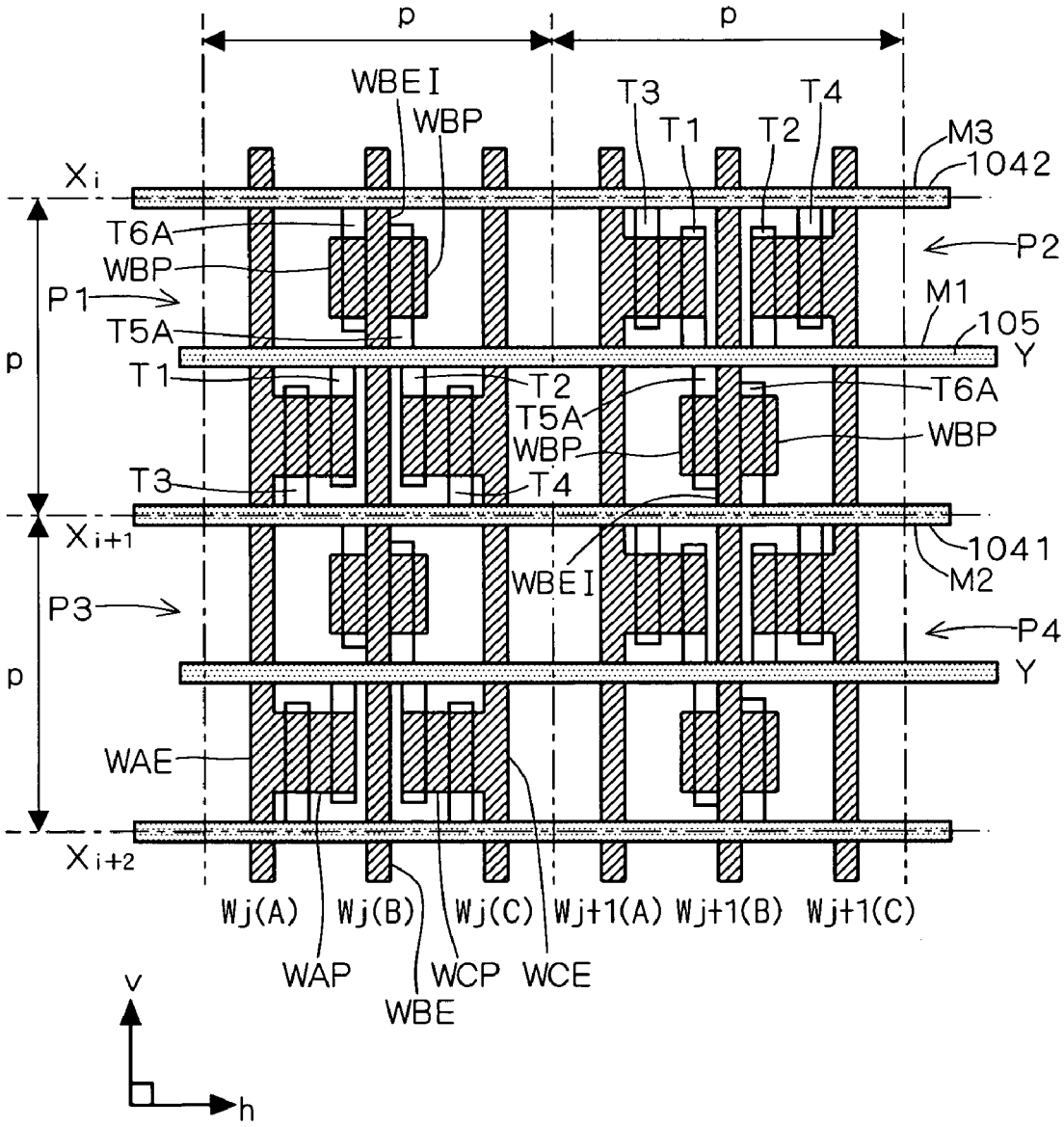
FIG. 12 is a perspective plan view showing a structure of an AC drive surface discharge reflection type PDP in accordance with a second preferred embodiment as viewed from the display surface side.

FIG. 12 is a perspective plan view schematically showing a structure of the AC drive surface discharge reflection type PDP having the isosceles delta array type pixel in accordance with the present preferred embodiment, which corresponds to FIG. 4 of the first preferred embodiment. Therefore, constituent elements of FIG. 12 identical to those of FIG. 4 are represented by the same reference signs. The present preferred embodiment is different from the first preferred embodiment in shape and size of the fifth and sixth transparent electrodes and shape of the first write electrode, in the isolated subpixel region ISPR. Discussion will be made, referring to FIG. 12, only on the characteristic feature and description on the constituent elements common to the first preferred embodiment will be omitted, using the corresponding description in the first preferred embodiment.

As shown in FIG. 12, the first write electrode Wj(B) comprises (1) an extending portion WBE extending in parallel to the vertical direction v and having a rectangular cross section and (2) a protruding portion WBP protruding from a portion WBEI of the extending portion WBE which is positioned in the isolated subpixel region ISPR towards at least the second write electrode Wj(A) along the horizontal direction h. In this exemplary case, the protruding portion WBP protrudes not only towards the second write electrode Wj(A) but also towards the third write electrode Wj(C) by the same distance. Thus, the first write electrode Wj(B) in the isolated subpixel region ISPR has the portion WBP which protrudes so that the distance between the first write electrode Wj(B) and a transparent electrode portion T6A for X electrode in the isolated subpixel region ISPR can become minimum.

Further, a fifth transparent electrode T5A of the first pixel P1 protrudes from a portion of the first metal auxiliary electrode M1 which is positioned adjacently to the above electrode portion grade-separately intersecting the first write electrode Wj(B) on a side of one of the second and third write electrodes (herein, on the side of the third write electrode Wj(C)), in parallel to the vertical direction v, and has a rectangular cross section. The fifth transparent electrode T5A of the second pixel P2 protrudes from a portion positioned adjacently to the above grade-separated intersection electrode portion on a side of the second write electrode Wj+1(A).

On the other hand, the sixth transparent electrode T6A protrudes from a portion of the third metal auxiliary electrode M3 which is positioned adjacently to the above electrode portion grade-separately intersecting the first write electrode Wj(B) on a side of the other one of the second and third write electrodes (herein, on the side of the second write electrode Wj(A)), in parallel to the vertical direction v, being so opposed to a side surface of the fifth transparent electrode T5A as to sandwich the extending portion WBEI therebetween, and has a rectangular cross section. The sixth transparent electrode T6A of the second pixel P2 protrudes from a portion positioned adjacently to the above grade-separated intersection electrode portion on a side of the third write electrode Wj+1(C).

The fifth transparent electrode T5A and the sixth transparent electrode T6A both have the same shape and size as the first transparent electrode T1. Therefore, in the present preferred embodiment, all the transparent electrodes T1, T2, T3, T4, T5A and T6A have the same shape and same size as each other.

<Action and Effect>

Thus, since the isolated subpixel and the pair subpixels have the same shape and size, there is no variation in writing voltage margin among the subpixels and as a result, it is possible to make the whole writing voltage margin larger than that of the first preferred embodiment.

The Third Preferred Embodiment

<Structure>

Figure 13:
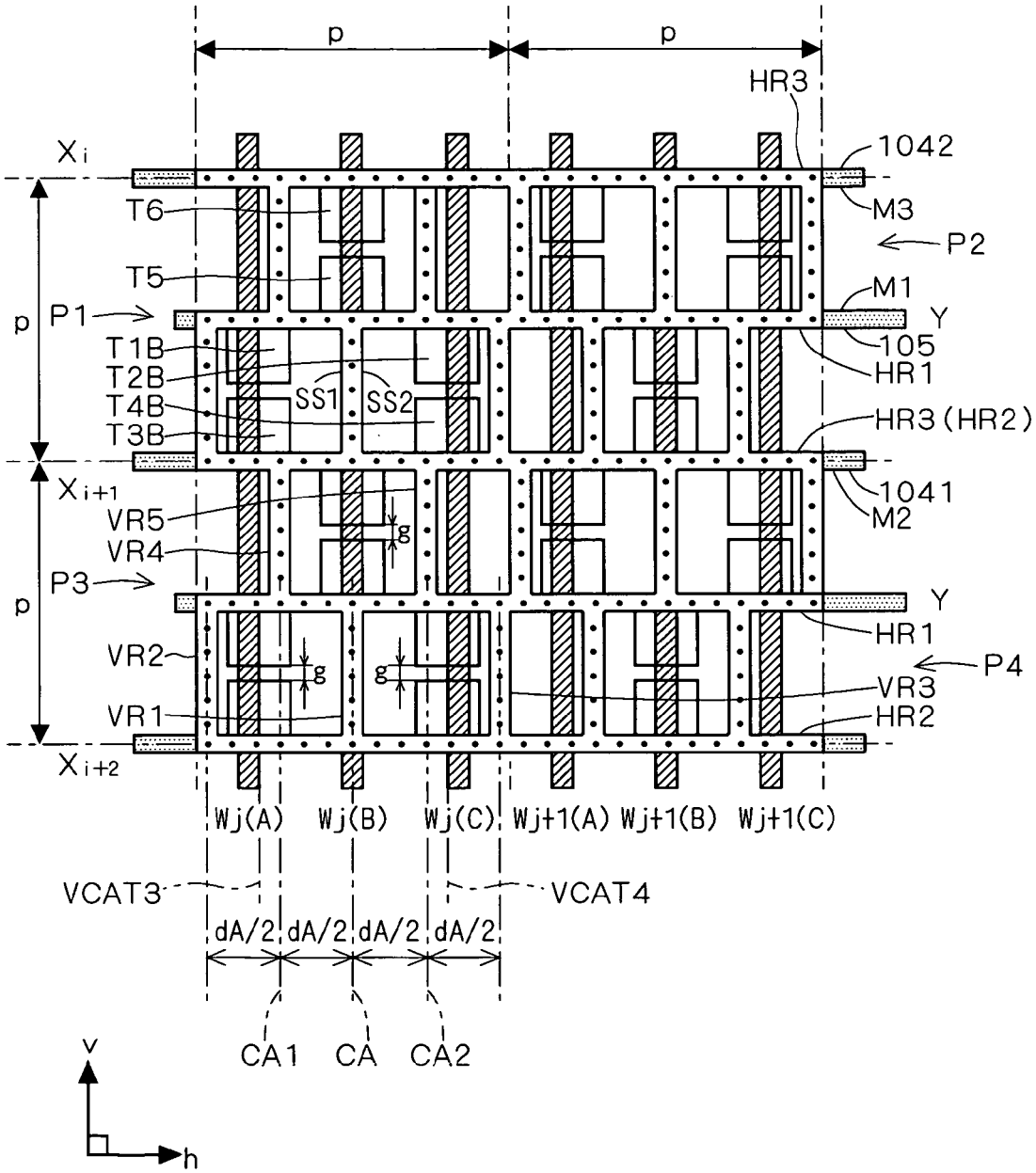
FIG. 13 is a perspective plan view showing a structure of an AC drive surface discharge reflection type PDP in accordance with a third preferred embodiment as viewed from the display surface side.

FIG. 13 is a perspective plan view showing a structure of the AC drive surface discharge reflection type PDP in accordance with the third preferred embodiment as viewed from the display surface side, which corresponds to FIG. 4 of the first preferred embodiment. In FIG. 13, a group of barrier ribs are also shown perspectively. Further, in FIG. 13, for good illustration of plan view, the order of layered members is different from that of FIG. 1 in the first preferred embodiment, but the actual vertically-positional relation of the members in the third preferred embodiment is the same as that in the first preferred embodiment.

While the principle of operation in the present preferred embodiment is the same as that in the first preferred embodiment, the difference in structure of these preferred embodiments lies in shape and arrangement of the first transparent electrode and the third transparent electrode, shape and arrangement of the second transparent electrode and the fourth transparent electrode, arrangement of the second vertical barrier rib, the third vertical barrier rib, the fourth vertical barrier rib and the fifth vertical barrier rib, and shape of the second write electrode and the third write electrode. Discussion will be made below, referring to FIG. 13, on the characteristic feature in structure of the present preferred embodiment, with the difference centered. Description on the constituent elements common to the first preferred embodiment will be omitted, using the reference signs of the first preferred embodiment.

First, a spacing dA between the vertical direction central axis of the first barrier rib VR1 and the vertical direction central axis of the second barrier rib VR2 is larger than a spacing d of FIG. 4. Specifically, while the second barrier rib VR2 is positioned immediately above the second write electrode Wj(A) (the vertical direction central axes of these members are also coincident with each other) in FIG. 4, the spacing dA is set so that the second write electrode Wj(A) can be positioned between these barrier ribs VR1 and VR2 in FIG. 13.

Similarly, the spacing dA between the vertical direction central axis of the first barrier rib VR1 and the vertical direction central axis of the third barrier rib VR3 is also larger than the spacing d of FIG. 4. Specifically, while the third barrier rib VR3 is positioned immediately above the third write electrode Wj(C) (the vertical direction central axes of these members are also coincident with each other) in FIG. 4, the spacing dA is set so that the third write electrode Wj(C) can be positioned between these barrier ribs VR1 and VR3 in FIG. 13.

Similarly, the spacing dA between the vertical direction central axis of the fourth barrier rib VR4 and the vertical direction central axis of the fifth barrier rib VR5 is also larger than the corresponding spacing d of FIG. 4. Specifically, the spacing dA is set so that the vertical direction central axis of the first write electrode Wj(B) can be positioned at the center between these barrier ribs VR4 and VR5.

The second write electrode Wj(A) consists only of an extending portion extending in parallel to the vertical direction v and having a rectangular cross section. Moreover, a portion of the extending portion of the second write electrode Wj(A) which is positioned in the first pair subpixel region PSPR1 is positioned between a first opposed side surface SS1 of the first vertical barrier rib VR1 and an opposed side surface of the second vertical barrier rib VR2, being closer to the opposed side surface of the second vertical barrier rib VR2.

Similarly, the third write electrode Wj(C) consists only of an extending portion extending in parallel to the vertical direction v and having a rectangular cross section. Moreover, a portion of the extending portion of the third write electrode Wj(C) which is positioned in the second pair subpixel region PSPR2 is positioned between a second opposed side surface SS2 of the first vertical barrier rib VR1 which is opposite to the first opposed side surface SS1 and an opposed side surface of the third vertical barrier rib VR3, being closer to the opposed side surface of the third vertical barrier rib VR3.

On the other hand, a first transparent electrode T1B and a third transparent electrode T3B are each positioned immediately above the above portion in the extending portion of the second write electrode Wj(A) which is positioned in the first pair subpixel region PSPR1 and each have a rectangular cross section. A tip portion of the first transparent electrode T1B is opposed to a tip portion of the third transparent electrode T3B with a predetermined spacing g, and the transparent electrodes T1B and T3B have the same shape and same size.

Similarly, a second transparent electrode T2B and a fourth transparent electrode T4B are each positioned immediately above the above portion in the extending portion of the third write electrode Wj(C) which is positioned in the second pair subpixel region PSPR2 and each have a rectangular cross section. A tip portion of the second transparent electrode T2B is opposed to a tip portion of the fourth transparent electrode T4B with the predetermined spacing g, and the transparent electrodes T2B and T4B have the same shape and same size.

With respect to the structure of the isolated subpixel region ISPR, the fifth transparent electrode T5 protrudes from the above electrode portion grade-separately intersecting the first write electrode Wj(B), a portion positioned adjacently to the grade-separated intersection electrode portion on the side of the second write electrode Wj(A) and a portion positioned adjacently to the grade-separated intersection electrode portion on the side of the third write electrode Wj(C) in the first metal auxiliary electrode M1, along the vertical direction v. The sixth transparent electrode T6 protrudes from the above electrode portion grade-separately intersecting the first write electrode Wj(B), a portion positioned adjacently to the grade-separated intersection electrode portion on the side of the second write electrode Wj(A) and a portion positioned adjacently to the grade-separated intersection electrode portion on the side of the third write electrode Wj(C) in the third metal auxiliary electrode M3, along the vertical direction v. The tip portion of the sixth transparent electrode T6 is opposed to the tip portion of the fifth transparent electrode T5 with the predetermined spacing g, and the fifth transparent electrode T5 and the sixth transparent electrode T6 both have the same shape and same size as the first transparent electrode T1B. Therefore, all the transparent electrodes T1B, T2B, T3B, T4B, T5 and T6 have the same shape and same size.

Also in FIG. 13, the vertical direction central axis VCAT3 of the first and third transparent electrodes T1B and T3B is positioned closer to the second vertical barrier rib VR2 as viewed from the vertical direction central axis CA1 of the first pair subpixel region PSPR1. Therefore, the third transparent electrode T3B is provided at a portion farthest away from the first write electrode Wj(B).

Similarly, the vertical direction central axis VCAT4 of the second and fourth transparent electrodes T2B and T4B is positioned closer to the third vertical barrier rib VR3 as viewed from the vertical direction central axis CA2 of the second pair subpixel region PSPR2. Therefore, the fourth transparent electrode T4 is also provided at a portion farthest away from the first write electrode Wj(B) on the other side.

In contrast to this, the vertical direction central axis of the fifth and sixth transparent electrodes T5 and T6 is coincident with the vertical direction central axis CA of the isolated subpixel region ISPR or the first write electrode Wj(B) as the present PDP is viewed from the side of the display surface FSOS.

Thus, in the third preferred embodiment, the electrode structure of the transparent electrode portion T6 for X electrode and the transparent electrode portion T5 for Y electrode in the isolated subpixel region ISPR, the electrode structure of the transparent electrode portion T3B for X electrode and the transparent electrode portion T1B for Y electrode in the pair subpixel region PSPR1 and the electrode structure of the transparent electrode portion T4B for X electrode and the transparent electrode portion T2B for Y electrode in the pair subpixel region PSPR2 have the same shape and same size. Additionally, the respective electrodes Wj(A), Wj(B) and Wj(C) have no protruding portion and the cross sections thereof are simply rectangle. In the isolated subpixel, the vertical direction central axis CA of the isolated subpixel region ISPR constituted of four ribs and the vertical direction central axis of the transparent electrode portions T5 and T6 and the first write electrode Wj(B) coincide with each other. On the other hand, in the pair subpixels, the vertical direction central axis CA1 of the first subpixel region PSPR1, which is one of the pair subpixels, is not coincident with the vertical direction central axis of the transparent electrode portions T3B and T1B and the second write electrode Wj(A), and the transparent electrode portions T3B and T1B are positioned farther away from the first write electrode Wj(B) in the isolated subpixel. The second subpixel region PSPR2 which is the other of the pair subpixels, also has the same structure.

<Action and Effect>

With the above arrangement, since the transparent electrode portions T3B and T4B for X electrode in the pair subpixel regions PSPR1 and PSPR2, respectively, are positioned farther away from the write electrode Wj(B) in the isolated subpixel region, the wrong writing discharge hardly occurs, like in the first preferred embodiment.

Additionally, in the present preferred embodiment, since all the transparent electrodes have the same shape and same size, the voltage margin does not become narrow and it is possible to increase the whole writing voltage margin, like in the second preferred embodiment.

Though the write electrodes W each consists only of the rectangular extending portion in FIG. 13, a protruding portion of the W electrode may be provided immediately below the X electrode in order to more easily cause the writing discharge between the W electrode and the X electrode, like in the first variation of the first preferred embodiment.

The Fourth Preferred Embodiment

<Point of Notice>

The present preferred embodiment uses the basic structure of the third preferred embodiment (FIG. 13) and the structure of the respective transparent electrodes is modified from another point of view.

Specifically, in the pair subpixels of the third preferred embodiment (FIG. 13), the vertical direction central axis of the transparent electrode for X electrode and the transparent electrode for Y electrode are not coincident with the vertical direction central axis of the pair subpixel region constituted of four ribs. By the way, the luminescence intensity in a cell has a distribution and the luminescence intensity becomes highest above the transparent electrodes. Therefore, in the third preferred embodiment, there is a possibility that the luminescence intensity in the pair subpixel becomes higher above the transparent electrodes. Thus, if a portion with high luminescence intensity is positioned on the side of the transparent electrode, i.e., an outer side, there is a possibility of reduction in effect of solving the color separation. The present preferred embodiment solves this problem.

<Structure>

Figure 14:
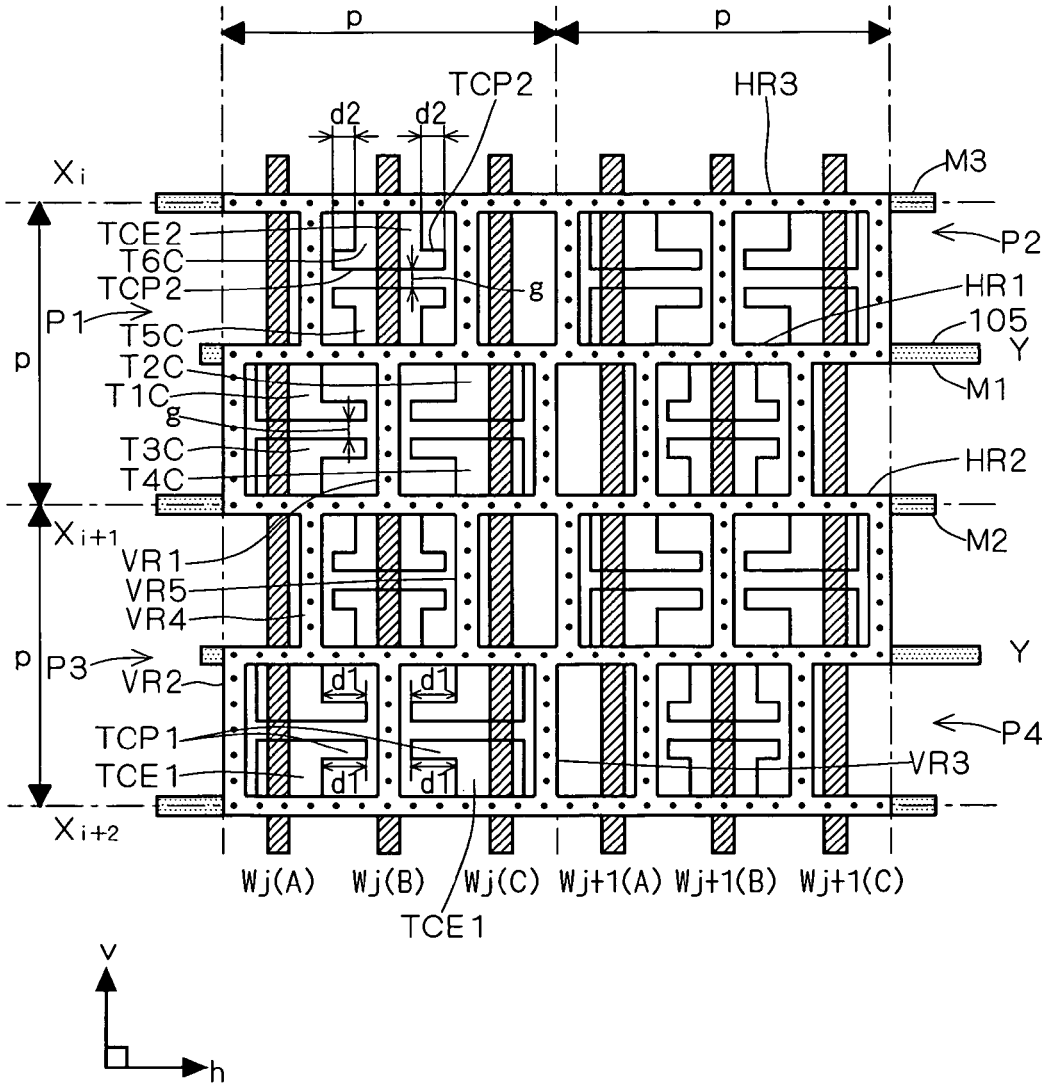
FIG. 14 is a perspective plan view showing a structure of an AC drive surface discharge reflection type PDP in accordance with a fourth preferred embodiment as viewed from the display surface side.

FIG. 14 is a perspective plan view showing a structure of the AC drive surface discharge reflection type PDP in accordance with the fourth preferred embodiment as viewed from the display surface side, which corresponds to FIG. 13. Since the characteristic feature of the present preferred embodiment lies in structure of the respective transparent electrodes, other constituent elements are the same as those in the third preferred embodiment. Therefore, description on the constituent elements common to the third preferred embodiment will be omitted, using the corresponding descriptions in the third and first preferred embodiments.

First, the structure of the pair subpixel regions PSPR1 and PSPR2 will be discussed. As shown in FIG. 14, a first transparent electrode T1C, a second transparent electrode T2C, a third transparent electrode T3C and a fourth transparent electrode T4C each include (1) an extending portion TCE1 extending along the vertical direction v from connection between the transparent electrode and a corresponding bus electrode to a tip portion thereof (a spacing between the above tip portion and an opposed transparent electrode is g) and (2) a protruding portion TCP1 protruding from the above tip portion of the extending portion TCE1 and its vicinity towards the first write electrode Wj(B) by a first protrusion distance d1 along the horizontal direction h. Among these constituent elements, one different from those in the third preferred embodiment is the protruding portion TCP1. With this structure, the transparent electrodes T1C, T2C, T3C and T4C of the present preferred embodiment each have an L-shaped cross section.

On the other hand, with respect to the isolated subpixel region ISPR, a fifth transparent electrode T5C and a sixth transparent electrode T6C each include (1) an extending portion TCE2 extending along the vertical direction v from connection between the transparent electrode and a corresponding bus electrode to a tip portion thereof (a spacing between the above tip portion and an opposed transparent electrode is g) and (2) a protruding portion TCP2 protruding from the above tip portion of the extending portion TCE2 and its vicinity towards both the second write electrode Wj(A) and the third write electrode Wj(C) by a second protrusion distance d2 along the horizontal direction h. Among these constituent elements, one different from those in the third preferred embodiment is the protruding portion TCP2. With this structure, the fifth transparent electrode T5C and the sixth transparent electrode T6C of the present preferred embodiment each have a T-shaped cross section.

<Action and Effect>

The present preferred embodiment produces the following action and effect as well as the action and effect of the third preferred embodiment.

Specifically, the resistance of each transparent electrode is much larger than that of the bus electrode connected to the transparent electrode. Therefore, a voltage applied to the extending portion TCE1 or TCE2 of each transparent electrode has a distribution depending on the distance from the connection between the transparent electrode and the bus electrode to the tip portion. In more detail, since a potential is applied more to the connection between the extending portion and the corresponding bus electrode, the applied voltage becomes highest at the connection, decreasing towards the tip portion, and becomes considerably lower value at the tip portion of the extending portion as compared with that at the connection. Therefore, the writing discharge between the transparent electrode for X electrode and the write electrode W immediately therebelow is caused mainly at the connection and the vicinity. Therefore, positioning the extending portion TCE1 of the transparent electrode in the each pair subpixel region farther away from the first write electrode Wj(B) in the isolated subpixel region produces an effect of suppressing the wrong discharge.

On the other hand, the protruding portion TCP1 of the each transparent electrode consists of the tip portion where the applied voltage is the minimum because of being farthest away from the corresponding bus electrode and its vicinity. Therefore, the degree of contribution of the protruding portion TCP1 to the writing discharge is low, and instead, the degree of contribution of the protruding portions TCP1 and TCP2 to the sustain discharge between the X electrode and the Y electrode is high. The protruding portions TCP1 and TCP2 of the transparent electrodes in the pair subpixel regions and the isolated subpixel region have the same arrangement. Therefore, with respect to the sustain discharge, the deviation of luminescence intensity distribution is relieved and the center of the subpixel and the center of the distribution of luminescence intensity are coincident with each other.

Though the write electrodes W each consist only of the rectangular extending portion in FIG. 14, a protruding portion of the W electrode may be provided immediately below the X electrode in order to more easily cause a writing discharge between the W electrode and the X electrode, like the structure in the first variation of the first preferred embodiment.

(Notes)

While the invention has been shown and described in detail, the foregoing description is in all aspects illustrative and not restrictive. It is therefore understood that numerous modifications and variations can be devised without departing from the scope of the invention.

INDUSTRIAL APPLICABILITY

The AC drive surface discharge reflection type PDP of the present invention can be used as a panel of a slim, lightweight and large-screen flat display device such as a commercial large-sized display device or a plasma television (TV).

Figure 15:
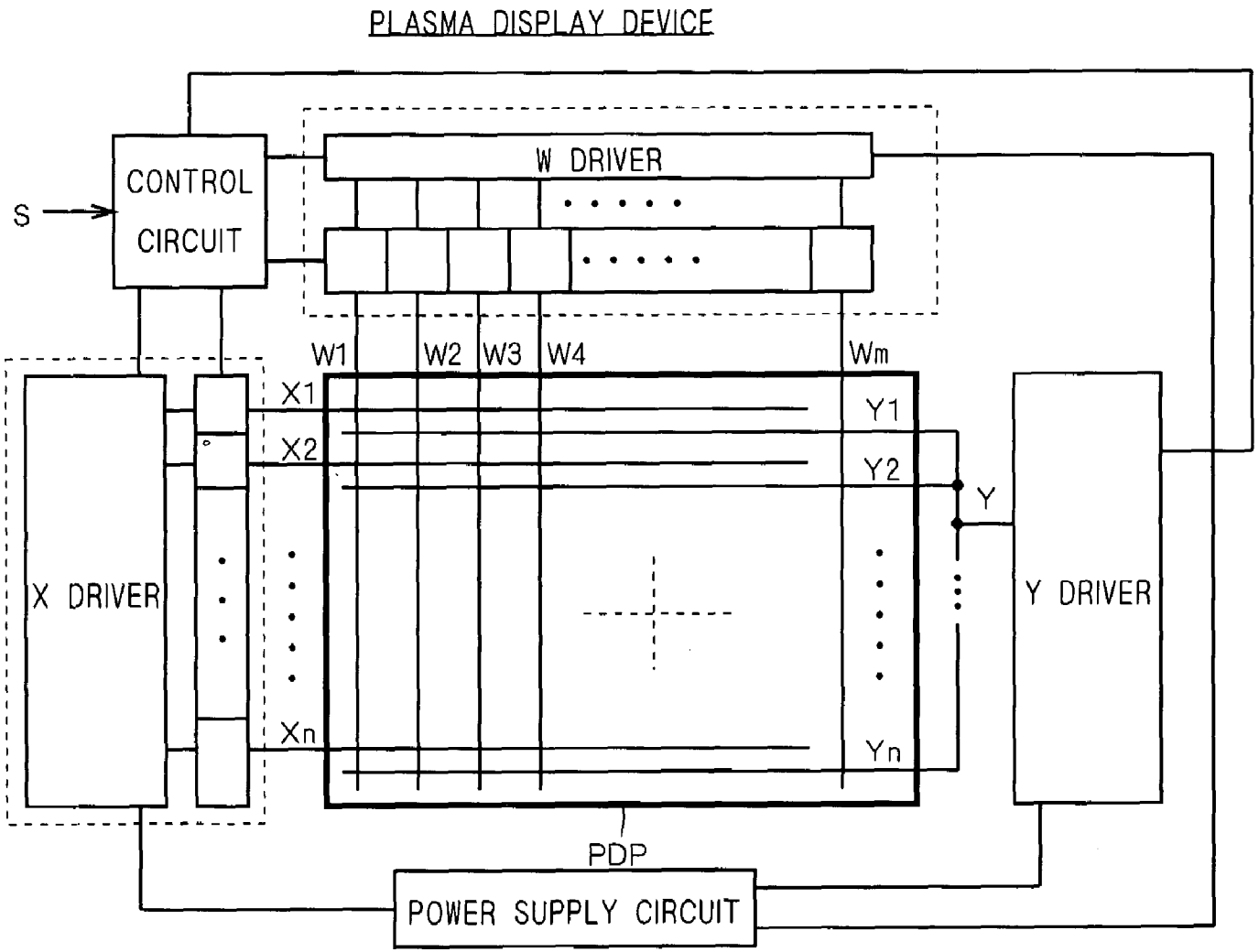
FIG. 15 is a block diagram schematically showing a structure of a plasma display device having the AC drive surface discharge reflection type PDP in accordance with the first to fourth preferred embodiments.

FIG. 15 is a block diagram schematically showing a structure of a surface discharge type plasma display device having the AC drive surface discharge reflection type PDP in accordance with any one of the first to fourth preferred embodiments. As shown in FIG. 15, the plasma display device roughly comprises (1) a PDP body and (2) a driver for generating a signal to drive the PDP body on the basis of a data signal inputted from the outside and outputting the driving signal to the above-discussed electrodes of the PDP body. This driver is roughly constituted of a control circuit for receiving an external signal S, a W driver, an X driver, a Y driver and a power supply circuit of FIG. 15.

What is claimed is:

1. A surface discharge type plasma display panel comprising a pixel constituted of first, second and third subpixels which are positioned at respective vertices of an isosceles triangle, comprising:

a rear substrate comprising a first write electrode extending in a vertical direction and second and third write electrodes which sandwich said first write electrode therebetween and both extend in said vertical direction;

a front substrate comprising a peripheral portion sealed to said rear substrate, an outer surface forming a display surface and an inner surface opposed to an inner surface of said rear substrate;

a first horizontal barrier rib formed on said inner surface of said rear substrate, extending in a horizontal direction orthogonal to said vertical direction;

second and third horizontal barrier ribs formed on said inner surface of said rear substrate, which sandwich said first horizontal barrier rib therebetween and extend in said horizontal direction;

a first vertical barrier rib formed on a portion in said inner surface of said rear substrate which is positioned immediately above said first write electrode, extending in said vertical direction to connect said first and second horizontal barrier ribs to each other;

second and third vertical barrier ribs formed on said inner surface of said rear substrate, which sandwich said first vertical barrier rib therebetween, extend in said vertical direction and connect said first and second horizontal barrier ribs to each other;

a fourth vertical barrier rib formed on a portion in said inner surface of said rear substrate which is positioned between said first write electrode and said second write electrode, extending in said vertical direction to connect said first and third horizontal barrier ribs to each other;

a fifth vertical barrier rib formed on a portion in said inner surface of said rear substrate which is positioned between said first write electrode and said third write electrode, extending in said vertical direction to connect said first and third horizontal barrier ribs to each other;

a sustain electrode formed on said inner surface of said front substrate, extending in said horizontal direction to grade-separately intersect said first, second and third write electrodes;

first and second scan electrodes formed on said inner surface of said front substrate, which sandwich said sustain electrode therebetween, extend in said horizontal direction and grade-separately intersect said first, second and third write electrodes; and a dielectric layer formed on said inner surface of said front substrate, said dielectric layer covering said sustain electrode and said first and second scan electrodes and comprising a surface which is in contact with respective tops of said first horizontal barrier rib, said second horizontal barrier rib, said third horizontal barrier rib, said first vertical barrier rib, said second vertical barrier rib, said third vertical barrier rib, said fourth vertical barrier rib and said fifth vertical barrier rib, wherein said first write electrode is positioned at least in an isolated subpixel region defined by a vertical direction central axis of said fourth vertical barrier rib, a vertical direction central axis of said fifth vertical barrier rib, a horizontal direction central axis of said first horizontal barrier rib and a horizontal direction central axis of said third horizontal barrier rib, said second write electrode is positioned at least in a first pair subpixel region defined by a vertical direction central axis of said first vertical barrier rib, a vertical direction central axis of said second vertical barrier rib, said horizontal direction central axis of said first horizontal barrier rib and a horizontal direction central axis of said second horizontal barrier rib, said third write electrode is positioned at least in a second pair subpixel region defined by said vertical direction central axis of said first vertical barrier rib, a vertical direction central axis of said third vertical barrier rib, said horizontal direction central axis of said first horizontal barrier rib and said horizontal direction central axis of said second horizontal barrier rib, said first pair subpixel region forms said first subpixel positioned at one of vertices constituting a base of said isosceles triangle, said isolated subpixel region forms said second subpixel positioned at top of said isosceles triangle opposed to said base, and said second pair subpixel region forms said third subpixel positioned at the other one of vertices constituting said base, said surface discharge type plasma display panel further comprising:

a first phosphor layer formed on at least said inner surface of said rear substrate in said first pair subpixel region;

a second phosphor layer formed on at least said inner surface of said rear substrate in said isolated subpixel region; and a third phosphor layer formed on at least said inner surface of said rear substrate in said second pair subpixel region, wherein said sustain electrode comprises:

a first metal auxiliary electrode positioned immediately above said first horizontal barrier rib, extending in said horizontal direction;

a first transparent electrode positioned in said first pair subpixel region, protruding from a portion of said first metal auxiliary electrode which is positioned between a portion positioned immediately above a connection between said first horizontal barrier rib and said first vertical barrier rib and a portion positioned immediately above a connection between said first horizontal barrier rib and said second vertical barrier rib towards said first scan electrode;

a second transparent electrode positioned in said second pair subpixel region, protruding from a portion of said first metal auxiliary electrode which is positioned between said portion positioned immediately above said connection between said first horizontal barrier rib and said first vertical barrier rib and a portion positioned immediately above a connection between said first horizontal barrier rib and said third vertical barrier rib towards said first scan electrode; and a fifth transparent electrode positioned in said isolated subpixel region, protruding from at least a portion of said first metal auxiliary electrode which is positioned adjacently to a grade-separated intersection with said first write electrode on a side of said third write electrode, towards said second scan electrode in parallel to said first write electrode, said first scan electrode comprises:

a second metal auxiliary electrode positioned immediately above said second horizontal barrier rib, extending in said horizontal direction;

a third transparent electrode positioned in said first pair subpixel region, protruding from a portion of said second metal auxiliary electrode which is positioned between a portion positioned immediately above a connection between said second horizontal barrier rib and said first vertical barrier rib and a portion positioned immediately above a connection between said second horizontal barrier rib and said second vertical barrier rib towards said sustain electrode; and a fourth transparent electrode positioned in said second pair subpixel region, protruding from a portion of said second metal auxiliary electrode which is positioned between said portion positioned immediately above said connection between said second horizontal barrier rib and said first vertical barrier rib and a portion positioned immediately above a connection between said second horizontal barrier rib and said third vertical barrier rib towards said sustain electrode, said second scan electrode comprises:

a third metal auxiliary electrode positioned immediately above said third horizontal barrier rib, extending in said horizontal direction; and a sixth transparent electrode positioned in said isolated subpixel region, protruding from at least a portion of said third metal auxiliary electrode which is positioned adjacently to a grade-separated intersection with said first write electrode on a side of said second write electrode, towards said sustain electrode in parallel to said first write electrode, said third transparent electrode is positioned immediately above said second write electrode and a vertical direction central axis of said third transparent electrode is positioned on a side of said second vertical barrier rib from a vertical direction central axis of said first pair subpixel region, and said fourth transparent electrode is positioned immediately above said third write electrode and a vertical direction central axis of said fourth transparent electrode is positioned on a side of said third vertical barrier rib from a vertical direction central axis of said second pair subpixel region.

2. The surface discharge type plasma display panel according to claim 1, wherein said second write electrode comprises:

an extending portion extending in parallel to said vertical direction and including a rectangular cross section; and a protruding portion protruding from a portion of said extending portion which is positioned in said first pair subpixel region towards said first write electrode along said horizontal direction, said third write electrode comprises:

an extending portion extending in parallel to said vertical direction and including a rectangular cross section; and a protruding portion protruding from a portion of said extending portion which is positioned in said second pair subpixel region towards said first write electrode along said horizontal direction, said first transparent electrode extends from a portion of said first metal auxiliary electrode which is positioned adjacently to said portion positioned immediately above said connection between said first horizontal barrier rib and said first vertical barrier rib on a side of said second write electrode in parallel to said vertical direction, and comprises a rectangular cross section, said second transparent electrode extends from a portion of said first metal auxiliary electrode which is positioned adjacently to said portion positioned immediately above said connection between said first horizontal barrier rib and said first vertical barrier rib on a side of said third write electrode in parallel to said vertical direction, and comprises a rectangular cross section, said third transparent electrode extends from a portion of said second metal auxiliary electrode which is positioned adjacently to said portion positioned immediately above said connection between said second horizontal barrier rib and said second vertical barrier rib on a side of said first write electrode, being opposed to a side surface of said first transparent electrode, in parallel to said vertical direction, comprises a rectangular cross section and is positioned immediately above said protruding portion of said second write electrode, said fourth transparent electrode extends from a portion of said second metal auxiliary electrode which is positioned adjacently to said portion positioned immediately above said connection between said second horizontal barrier rib and said third vertical barrier rib on a side of said first write electrode, being opposed to a side surface of said second transparent electrode, in parallel to said vertical direction, comprises a rectangular cross section and is positioned immediately above said protruding portion of said third write electrode, and said first transparent electrode, said second transparent electrode, said third transparent electrode and said fourth transparent electrode comprise the same shape and same size as each other.

3. The surface discharge type plasma display panel according to claim 2, wherein said fifth transparent electrode protrudes from said grade-separated intersection with said first write electrode a portion positioned adjacently to said grade-separated intersection on a side of said second write electrode and a portion positioned adjacently to said grade-separated intersection on a side of said third write electrode in said first metal auxiliary electrode, said sixth transparent electrode protrudes from said grade-separated intersection with said first write electrode, a portion positioned adjacently to said grade-separated intersection on a side of said second write electrode and a portion positioned adjacently to said grade-separated intersection on a side of said third write electrode in said third metal auxiliary electrode, a tip portion of said sixth transparent electrode is opposed to a tip portion of said fifth transparent electrode with a predetermined spacing therebetween, said fifth transparent electrode and said sixth transparent electrode comprise the same shape and same size, and said first write electrode comprises:

an extending portion extending in parallel to said vertical direction and including a rectangular cross section; and a protruding portion protruding from a portion of said extending portion of said first write electrode which is positioned in said isolated subpixel region and immediately below said sixth transparent electrode, towards a portion immediately below a side surface of said sixth transparent electrode along said horizontal direction.

4. The surface discharge type plasma display panel according to claim 2, wherein said first write electrode comprises:

an extending portion extending in parallel to said vertical direction and including a rectangular cross section; and a protruding portion protruding from a portion of said extending portion of said first write electrode which is positioned in said isolated subpixel region, towards said second write electrode along said horizontal direction, said fifth transparent electrode protrudes from a portion of said first metal auxiliary electrode which is positioned adjacently to said grade-separated intersection with said first write electrode on a side of one of said second write electrode and said third write electrode, in parallel to said vertical direction, and comprises a rectangular cross section, said sixth transparent electrode protrudes from a portion of said third metal auxiliary electrode which is positioned adjacently to said grade-separated intersection with said first write electrode on a side of the other one of said second write electrode and said third write electrode, being opposed to a side surface of said fifth transparent electrode, in parallel to said vertical direction, and comprises a rectangular cross section, and said fifth transparent electrode and said sixth transparent electrode both comprise the same shape and same size as said first transparent electrode.

5. The surface discharge type plasma display panel according to claim 1, wherein said second write electrode comprises:

an extending portion extending in parallel to said vertical direction and including a rectangular cross section, a portion of said extending portion of said second write electrode which is positioned in said first pair subpixel region is positioned between a first opposed side surface of said first vertical barrier rib and an opposed side surface of said second vertical barrier rib, being closer to said opposed side surface of said second vertical barrier rib, said third write electrode comprises:

an extending portion extending in parallel to said vertical direction and including a rectangular cross section, a portion of said extending portion of said third write electrode which is positioned in said second pair subpixel region is positioned between a second opposed side surface of said first vertical barrier rib which is opposite to said first opposed side surface and an opposed side surface of said third vertical barrier rib, being closer to said opposed side surface of said third vertical barrier rib, said first transparent electrode and said third transparent electrode are each positioned immediately above said portion in said extending portion of said second write electrode which is positioned in said first pair subpixel region, and each comprise a rectangular cross section, a tip portion of said first transparent electrode is opposed to a tip portion of said third transparent electrode with a predetermined spacing therebetween, said second transparent electrode and said fourth transparent electrode are each positioned immediately above said portion in said extending portion of said third write electrode which is positioned in said second pair subpixel region, and each comprise a rectangular cross section, a tip portion of said second transparent electrode is opposed to a tip portion of said fourth transparent electrode with a predetermined spacing therebetween, and said first transparent electrode, said second transparent electrode, said third transparent electrode and said fourth transparent electrode comprise the same shape and same size as each other.

6. The surface discharge type plasma display panel according to claim 5, wherein said fifth transparent electrode protrudes from said grade-separated intersection with said first write electrode, a portion positioned adjacently to said grade-separated intersection on a side of said second write electrode and a portion positioned adjacently to said grade-separated intersection on a side of said third write electrode in said first metal auxiliary electrode, said sixth transparent electrode protrudes from said grade-separated intersection with said first write electrode, a portion positioned adjacently to said grade-separated intersection on a side of said second write electrode and a portion positioned adjacently to said grade-separated intersection on a side of said third write electrode in said third metal auxiliary electrode, a tip portion of said sixth transparent electrode is opposed to a tip portion of said fifth transparent electrode with a predetermined spacing therebetween, and said fifth transparent electrode and said sixth transparent electrode each comprise the same shape and same size as said first transparent electrode.

7. The surface discharge type plasma display panel according to claim 6, wherein each of said first transparent electrode, said second transparent electrode, said third transparent electrode and said fourth transparent electrode, comprises:

a protruding portion protruding from said tip portion and its vicinity towards said first write electrode by a first protrusion distance in said horizontal direction, keeping said predetermined spacing with the opposed transparent electrode, and said first transparent electrode, said second transparent electrode, said third transparent electrode and said fourth transparent electrode each comprise an L-shaped cross section.

8. The surface discharge type plasma display panel according to claim 7, wherein each of said fifth transparent electrode and said sixth transparent electrode comprises:

a protruding portion protruding from said tip portion and its vicinity towards both said second write electrode and said third write electrode by a second protrusion distance in said horizontal direction, keeping said predetermined spacing with the opposed transparent electrode, and said fifth transparent electrode and said sixth transparent electrode each comprise a T-shaped cross section.

9. A surface discharge type plasma display device, comprising:

the surface discharge type plasma display panel as defined in claim 1; and a driver configured to generate a signal for driving the surface discharge type plasma display panel.

10. A front panel used in the surface discharge type plasma display panel as defined in claim 1, comprising:

said front substrate;

said sustain electrode;

said first scan electrode;

said second scan electrode; and said dielectric layer.

* * * * *